US010278889B2

(12) United States Patent
Olschansky et al.

(10) Patent No.: US 10,278,889 B2
(45) Date of Patent: May 7, 2019

(54) MODULAR SELF-MASSAGE APPARATUS

(71) Applicant: GelliFlex Systems, LLC, Phoenix, AZ (US)

(72) Inventors: Craig A. Olschansky, Phoenix, AZ (US); William R. Hanson, Mountain View, CA (US); Donald Hollenbeck, Seaford, DE (US); Howard A. Wilson, IV, Campbell, CA (US)

( * ) Notice: Subject to any disclaimer, the term of this patent is extended or adjusted under 35 U.S.C. 154(b) by 454 days.

(21) Appl. No.: 15/044,113

(22) Filed: Feb. 16, 2016

(65) Prior Publication Data

US 2017/0231862 A1 Aug. 17, 2017

(51) Int. Cl.
*A61H 15/00* (2006.01)

(52) U.S. Cl.
CPC ... *A61H 15/0092* (2013.01); *A61H 2015/005* (2013.01); *A61H 2015/0014* (2013.01); *A61H 2015/0021* (2013.01); *A61H 2015/0064* (2013.01); *A61H 2201/0107* (2013.01); *A61H 2201/0157* (2013.01); *A61H 2201/0161* (2013.01)

(58) Field of Classification Search
CPC ..... A61H 15/00; A61H 15/0092; A61H 2015/005; A61H 2015/0007; A61H 2015/0014; A61H 2015/0021; A61H 2015/0042; A61H 2015/0064; A61H 2015/0071
See application file for complete search history.

(56) References Cited

U.S. PATENT DOCUMENTS

| | | | | |
|---|---|---|---|---|
| 2,223,263 | A | 11/1940 | Michaelson | |
| 2,638,089 | A * | 5/1953 | Murphy | A61H 15/00 601/118 |
| 3,583,396 | A | 6/1971 | Landis | |
| 3,759,250 | A * | 9/1973 | Salata | A61H 15/00 601/122 |
| 4,010,743 | A | 3/1977 | Fitzsimons | |
| 4,679,550 | A | 7/1987 | Quam et al. | |
| 5,352,188 | A | 10/1994 | Vitko | |
| 5,621,969 | A | 4/1997 | Masuda | |
| 5,792,081 | A | 8/1998 | Cross | |
| 5,913,839 | A | 6/1999 | Wincek | |
| 6,315,742 | B1 | 11/2001 | Howard | |
| 6,419,650 | B1 * | 7/2002 | Ryan | A61H 15/00 601/122 |
| 2007/0173750 | A1 | 7/2007 | Hudock | |
| 2009/0112137 | A1 * | 4/2009 | Lamore | A63B 21/0004 601/112 |
| 2010/0145240 | A1 | 6/2010 | Cromie | |
| 2014/0350443 | A1 | 11/2014 | Raines et al. | |
| 2015/0297393 | A1 | 10/2015 | McGushion | |

* cited by examiner

*Primary Examiner* — Timothy A Stanis
(74) *Attorney, Agent, or Firm* — Thomas W. Galvani, P.C.; Thomas W. Galvani

(57) ABSTRACT

A modular self-massaging apparatus includes a framework and a ball assembly mounted to the framework. The ball assembly is modular and can be disassembled and reassembled in a variety of configurations. The apparatus is modular because the ball assembly and other ball assemblies can be applied to and carried in the apparatus at a variety of locations across the apparatus.

17 Claims, 19 Drawing Sheets

MODULAR SELF-MASSAGE APPARATUS

FIELD OF THE INVENTION

The present invention relates generally to physical therapy, and more particularly to physical therapy self-massage devices.

BACKGROUND OF THE INVENTION

Millions of people suffer from body pains and discomforts, from general soreness to neuropathy. Treatments range from surgery, to pharmaceutical and naturopathic preparations, to strength and physical therapy, to massage therapy. Massage therapy can be provided by a professional masseuse, but can also be provided by the individual. This is known as self-massage.

Numerous types of massage and self-massage tools exist. However, most suffer from at least several problems. Many self-massage tools rely on hard implements. In what has become known as "trigger-point" massage therapy, self-massage tools will be used to relax or release tightness and pain, such as may be caused by friction between muscle fascia or a spasm in muscle tissue. This therapy is often used by athletes and generally relies on very hard implements to apply a large amount of concentrated, focused force on a small, specific area. Such tools are generally not helpful for individuals suffering from neuropathy or for those desiring a more pleasant massage.

Many self-massage tools require a great deal of force to be effective. Massage tools which require force can be difficult for an individual to use in a self-massage. It is simply just a difficult thing to exert force on one's own body. And, exerting large forces can be painful, causing the individual to abate the force.

Further, many self-massage tools require the individual to assume an odd or awkward position. For instance, to massage one's own calf, an individual has to sit at the end of a surface, such as a coffee table, bend over, and hold an implement behind their own leg while rolling or digging the implement into the calf. This is an awkward position: it can be difficult to breathe because the diaphragm is constricted, blood rushes to the head, and it is hard to reach behind one's own leg. Additionally, for many individuals who suffer from neuropathy, they may have associated ailments which limit their flexibility or ability to hold an uncomfortable position for more than a brief period of time.

Many self-massage tools inflict are very uncomfortable to use—they actually inflict pain before relieving pain. Tools which cause pain are ineffective because their use id frequently abandoned. Individuals would rather live with the mild pain of neuropathy than exert acute pain on themselves.

Still further, many self-massage tools are narrowly focused. They provide one kind of massage, or can only be used in a certain, or only with a specific body part. An individual who has discomfort all over the body may have to purchase several types of self-massage tools—and use each of them—to alleviate pain.

Clearly, a need for an effective tool for providing a self-massage without the above drawbacks is needed. A tool which is adaptable across a wide range of body parts and body pains and which is used with ease and without pain is desired.

SUMMARY OF THE INVENTION

A modular self-massaging apparatus includes a framework and a ball assembly mounted to the framework. The ball assembly is modular and can be disassembled and reassembled in a variety of configurations. Constituent parts of the ball assembly—an axle, nuts, and ball units—are capable of being rearranged to form new ball assemblies. The apparatus includes a plurality of capture means formed across the apparatus ready to receive and secure any of the various ball assemblies. This allows an individual to configure the apparatus uniquely for a massaging need, as the individual so desires and chooses.

BRIEF DESCRIPTION OF THE DRAWINGS

Referring to the drawings:

FIGS. 4H and 4I are top perspective views of yet still other embodiments of modular ball assemblies for use in the apparatus of FIG. 1;

DETAILED DESCRIPTION

Figure 1:
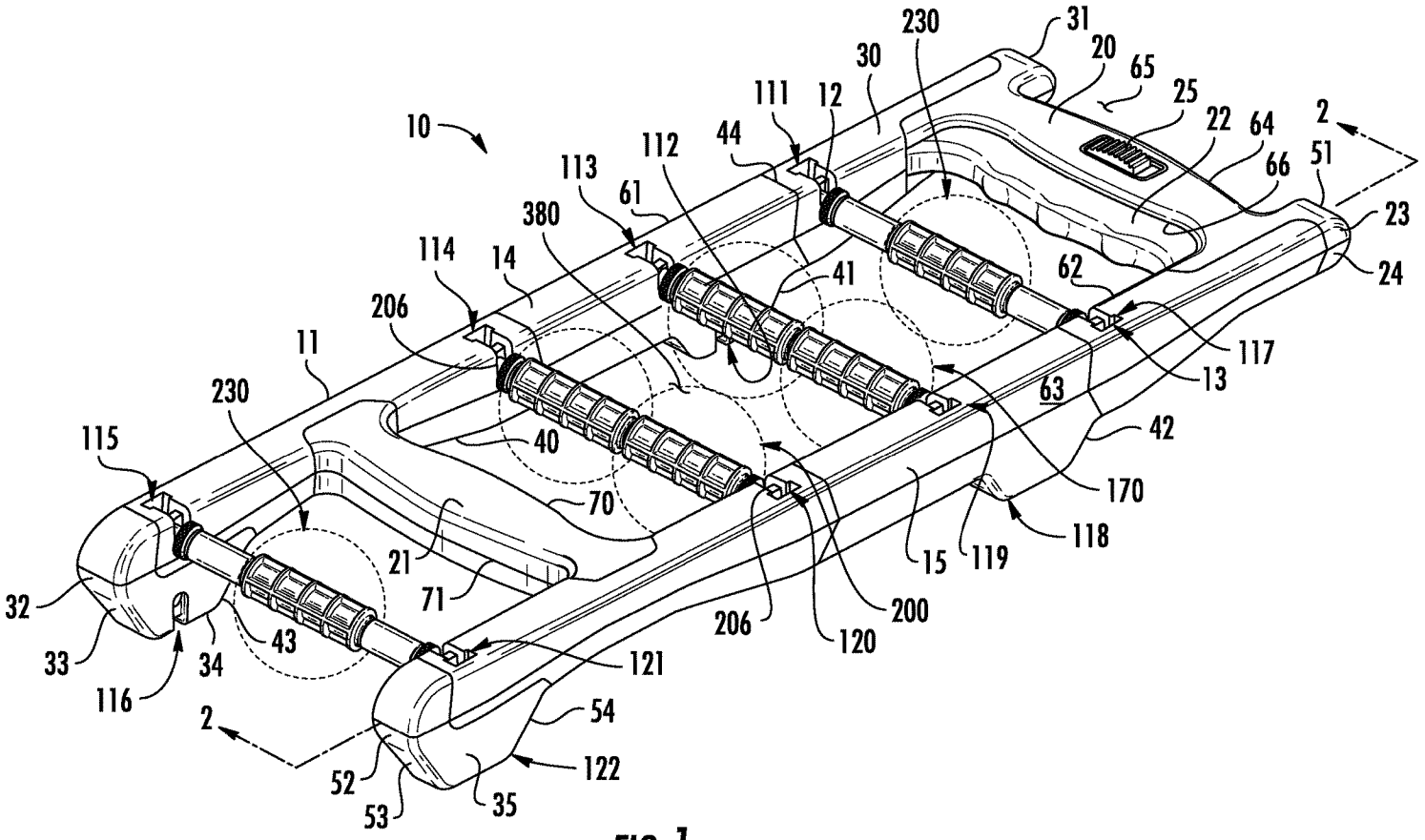
FIG. 1 is a top perspective view of an embodiment of a modular self-massage apparatus.

Reference now is made to the drawings, in which the same reference characters are used throughout the different figures to designate the same elements. FIG. 1 illustrates a modular self-massage apparatus 10 (hereinafter the "apparatus 10") useful for providing soft-tissue and therapeutic relief to individuals. The apparatus 10 allows an individual to give himself a productive, varied, and specific soft massage by providing him with a tool that can be configured in a plurality of disparate arrangements, each defining and allowing a different massage technique, for a different part of the body, with a different type of leverage. The apparatus 10 thus is a unique and effective mechanism for an individual to soothe many different parts of the body with a single tool.

Figure 2A:
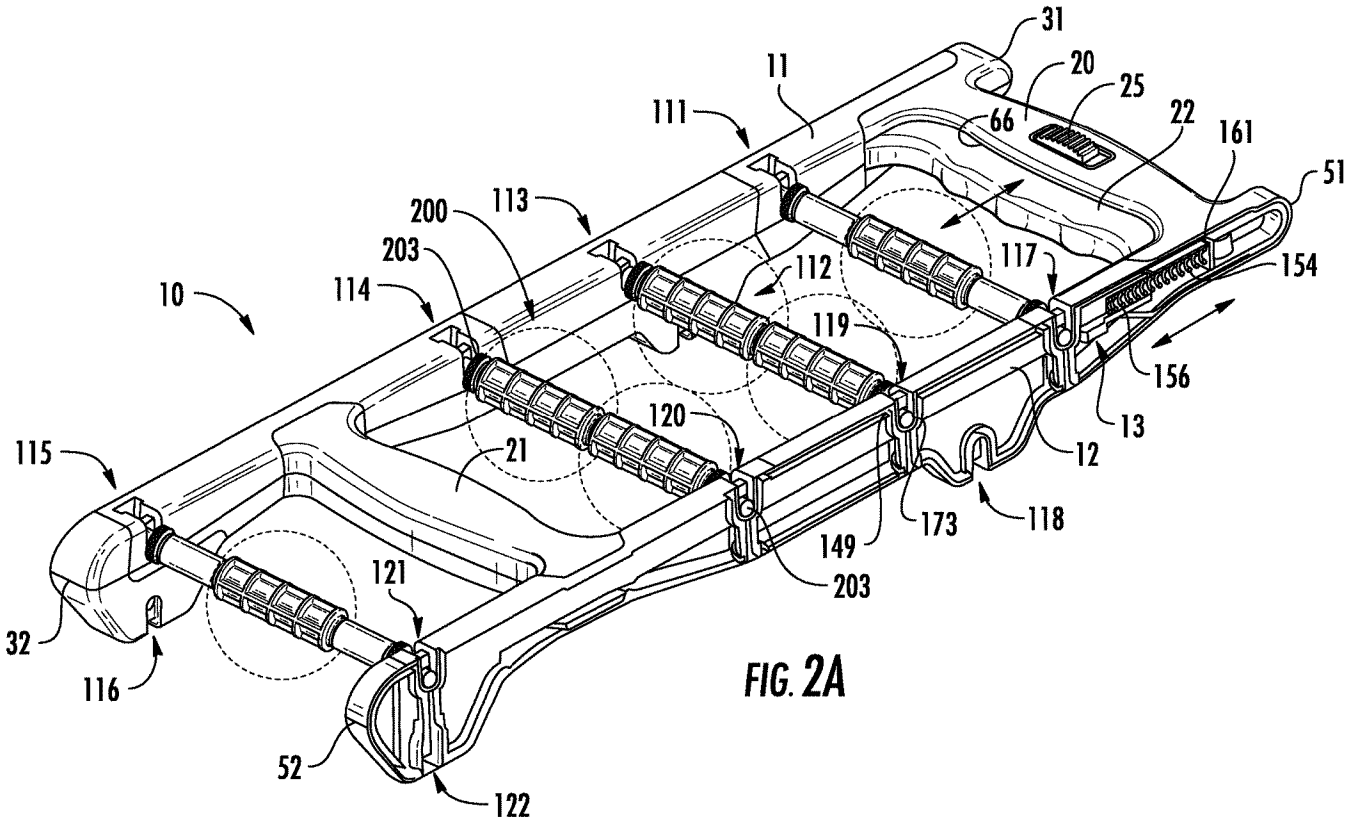
FIGS. 2A and 2B are top perspective section views of the apparatus of FIG. 1, taken along the line 2-2 in FIG. 1.
Figure 2B:
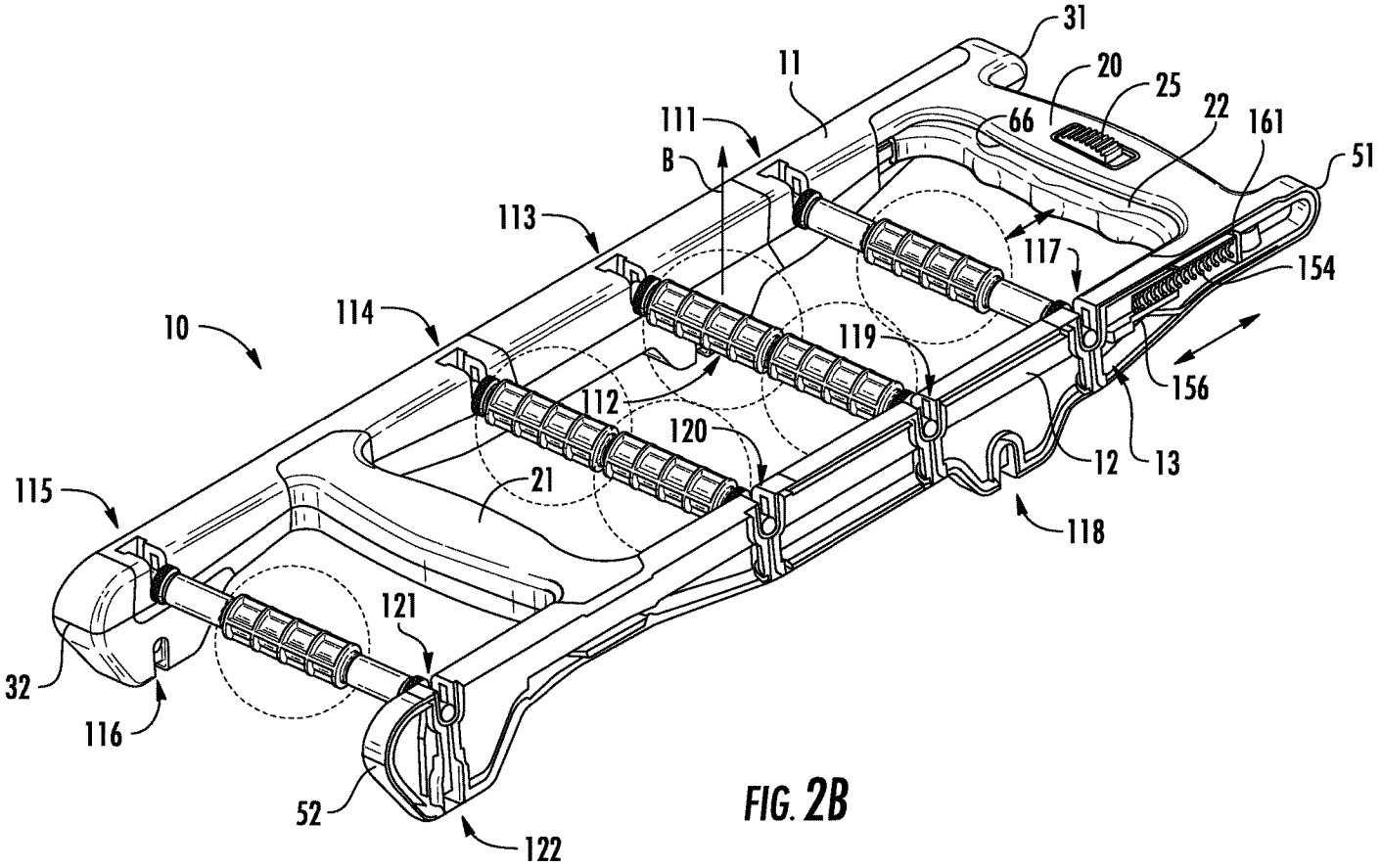

The apparatus 10 includes an external framework 11 carrying a predominantly internal chassis rail 12 (better seen in FIGS. 2A and 2B). The framework 11 and chassis rail 12 cooperate to form capture means, or cradles 13, across the apparatus 10 in which ball assemblies can be secured and carried. Though the ball assemblies are explained in detail later, it is briefly worth noting that the ball assemblies are modular; each can be disassembled and reassembled to form a different type of ball assembly. Modularity is achieved because each ball assembly, while unique, relies on similar or identical constituent parts, such as an axle. And the axle, for example, is dropped into the cradles as desired for free rotation therein, thus allowing the individual to change and customize the apparatus for different massages.

The framework 11 includes opposed side members 14 and 15, which are referred to herein for convenience purposes only as a left side member 14 and a right side member 15. The left side member 14 is elongate and relatively thin and short. The right side member 15 is similarly elongate and relatively thin and short. Indeed, the left and right side members 14 and 15 are identical but opposite in orientation on the framework 11, mirrored about a centerline extending therebetween. The left and right side members 14 and 15 are spaced apart from each other, are parallel with respect to each other, and, in this parallel fashion, are disposed in the same plane such that their tops are coplanar. The left and right side members 14 and 15 are available to be gripped by hand nearly anywhere along their entire lengths, so as to provide varied and unique hand angles to exert similarly varied and unique forces. Further, portions of the framework 11 are soft, covered, or over-molded to provide a comfortable and tacky location to be gripped.

The left and right side members 14 and 15 are spaced apart by two braces 20 and 21. The braces 20 and 21 define grips, or handles, serving not only to space the left and right side members 14 and 15 apart, but also to provide additional gripping and fulcrum locations for an individual. The brace 20 further includes a location at which a trigger 22 is exposed outside of the brace 20; the trigger 22 is operatively coupled to the chassis rail 12 to move the chassis rail 12 between open and closed positions, as is later described.

In the embodiment depicted in FIG. 1, the framework 11 appears bifurcated between a single top half 23 and a single bottom half 24. Indeed, in a preferred embodiment, the framework is constructed from as few pieces as possible to provide strength and rigidity to the apparatus 10. However, it has been found that an adequately durable, strong, and rigid apparatus 10 can be constructed with a two-piece framework 11 formed from the top half 23 and the bottom half 24 fastened together with screws, bolts, sonic welding, or like fastening method. It should be noted that although the terms "top half 23" and "bottom half 24" are used to describe portions of the framework, those portions are not true halves of a whole; they are not equal in size. The framework is constructed from a material or combination of materials having the material characteristics of low density, high rigidity, high tensile strength, high compressive strength, and durability, such as plastic. The braces 20 and 21 are formed integrally and monolithically to the left and right side members 14 and 15, though in some embodiments, for ease of manufacturing, the braces 20 and 21 are separate pieces fastened to the left and right side members 14 and 15.

The left side member 14 includes a top surface 30, which extends entirely across the right side member 15 and the braces 20 and 21. The top surface 30 is generally flat and straight, and uniquely extends in a single plane from the left side member 14, across the right side member 15, the brace 20, and the brace 21, so that the left and right side members 14 and 15 and the braces 20 and 21 terminate upwardly at a common flat surface. The flat top surface 30 allows the apparatus 10 to be flipped and placed on the ground with its top surface 30 down for a variety of massages in this orientation. The left side member 14 has a first end 31 and an opposed second end 32. As is seen in FIG. 1, the first end 31 is semi-circular, oriented transverse to the length of the left side member 14 and laterally away from the left side member 14. The first end 31 has an arcuate transition from the top surface 30. The second end 32 is quasi-semi-circular, and is also oriented transverse to the length of the left side member 14 and laterally away from the left side member 14, but is directed opposite to the first end 31. Further, the second end 32 has only approximately a 120 degree arcuate transition from the top surface 30, and then transitions to a diagonal but flat face 33 which defines part of a major foot 34 proximate to the second end 32. An opposed major foot 35 is formed on the right side member 15. The framework 12 around the major feet 32 and 52 is formed of, or more preferably covered in, a material having a soft and tacky characteristic. This provides both a soft and comfortable grip as well a secure, non-slip grip.

The left side member 14 further includes a bottom surface 40, which extends entirely between the ends 31 and 32. Like the top surface 30, the bottom surface 40 is common to the right side member 15 and the braces 20 and 21, but the bottom surface is curvilinear and does not lie in a single, flat plane. Cooperating with the top surface 30, the bottom surface 40 defines a thickness—in the vertical direction—of the left side member 14. Briefly, it is noted that the term "vertical" as used herein will refer to a direction on the apparatus 10 which extends from the bottom surface 40 to the top surface 30, or in the same direction as the reference characters. "Horizontal" or "lateral" will refer to a direction perpendicular to vertical, or extending along or between the left and right side members 14 and 15. Returning to the description of the thickness of the left side member 14, that thickness varies between the ends 31 and 32. Proximate to the first end 31, the bottom surface 40 is generally straight and parallel with respect to the top surface 30; thus, the left side member 14 has a generally constant thickness proximate to the first end 31. Between braces 20 and 21, however, the left side member 14 is formed with a minor foot 41 (an opposite minor foot 42 is formed on the right side member 15, as well). A portion of the left side member 14 around the minor foot 41 is formed of, or covered in, a material having a soft and tacky characteristic. This provides both a soft and comfortable grip as well a secure, non-slip grip. This portion is identified with the reference character 44. The minor foot 41 bounds and defines a well internal to the framework 11. The bottom surface 40 of the left side member slopes downward to this minor foot 41, and so the left side member 14 has an increasing thickness from the first end 31 to the minor foot 41. From the minor foot 41 to the brace 21, the bottom surface 40 slopes generally upward, and the thickness of the left side member 14 decreases from the minor foot 41 to the brace 21. The thickness of the left side member 14 at the brace 21 is approximately equal to the thickness of the left side member 14 proximate to the first end 31. The bottom surface 40 then cuts sharply downward to the major foot 34, with a diagonal but flat face 43 which defines a part of the major foot 34 proximate to the second end 32. Both the first and second ends 31 and 32 have a tacky material characteristic.

Referring still to FIGS. 1, 2A, and 2B, the right side member 15 is similar to the left side member 14. The top and bottom surfaces 30 and 40 of the left side member 14 are common to the right side member 15, and so reference to them will include specific identification in context of the right side member 15 to avoid confusion. Along the right side member 15, the top surface 30 is generally flat and straight, and extends from a first end 51 of the right side member 15 to an opposed second end 52 of the right side member 15. The first end 51 is semi-circular, oriented transverse to the length of the right side member 15 and laterally away from the right side member 15. The first end 51 has an arcuate transition from the top surface 30. The second end 52 is quasi-semi-circular, and is also oriented transverse to the length of the right side member 15 and laterally away from the right side member 15, but is directed opposite to the end 51. Further, the end 52 has only approximately a 120 degree arcuate transition from the top surface 30, and then transitions to a diagonal, but flat face 53 which defines part of the major foot 35 proximate to the end 52 and opposed from the major foot 34. Both the first and second ends 51 and 52 have a tacky material characteristic.

The bottom surface 40 of the right side member 15 is curvilinear and does not lie in a single, flat plane. Cooperating with the top surface 30, the bottom surface 40 along the right side member 15 defines a vertical thickness of the right side member 15. That thickness varies between the ends 51 and 52. Proximate to the end 51, the bottom surface 40 along the right side member 15 is generally straight and parallel with respect to the top surface 30; thus, the right side member 15 has a generally constant thickness proximate to the end 51. Between braces 20 and 21, however, the right side member 15 is formed with the minor foot 42. The bottom surface 40 along the right side member 15 slopes downward to this minor foot 42, and so the right side member 15 has an increasing thickness from the end 51 to the minor foot 42. A portion of the right side member 15 around the minor foot 42 is formed of, or covered in, a material having a soft and tacky characteristic. This provides both a soft and comfortable grip as well a secure, non-slip grip. The minor foot 42 defines an internal well within the framework 11, as will be explained later. From the minor foot 42 to the brace 21, the bottom surface 40 along the right side member 15 slopes generally upward, and the thickness of the right side member 15 decreases from the minor foot 42 to the brace 21. The thickness of the right side member 15 at the brace 21 is approximately equal to the left side member 14 at the brace 21, and also to the thickness of the right side member 15 proximate to the end 51. The bottom surface 40 along the right side member 15 then cuts sharply downward to the major foot 35, with a diagonal but flat face 54 which defines a part of the major foot 35 proximate to the end 52.

The left side member 14 includes opposed inner and outer surfaces 60 and 61, which are flat, generally smooth, and parallel to each other. The right side member 15 also includes opposed inner and outer surfaces 62 and 63, which are flat, generally smooth, and parallel to each other. The inner surfaces 60 and 62 are directed toward each other and are parallel, and the outer surfaces 61 and 63 are directed away from each other and are parallel. The inner surfaces 60 and 62 and the outer surfaces 61 and 63 are split between the upper and lower halves 23 and 24, though the upper and lower halves 23 and 24 are seated against each other smoothly such that there is only a very small, minor seam extending across the inner surfaces 60 and 62 and the outer surfaces 61 and 63.

With reference to FIG. 1, the brace 21 extends between the left and right side members 14 and 15. The brace 21 defines a fulcrum, which can be used against the inside of an individual's elbow, or gripped in the individual's hand, when the brace 21 is gripped, so as to provide increased, leveraged force on a body part if so needed. The brace 21 is a fulcrum because it provides a pivot point about which the apparatus 10 can be moved during a massage. The brace 21 includes the top surface 30 which extends across it from the left side member 14 to the right side member 15, and the bottom surface 40, which similarly extends across it between the left and right side members 14 and 15. The brace 21 includes opposed inner and outer faces 70 and 71, each of which defines a fulcrum face in that each can be used as the face against which—or about which—the apparatus 10 pivots. The brace 21 is formed of, or covered in, a material having a soft and tacky characteristic. This provides both a soft and comfortable grip as well a secure, non-slip grip.

The brace 20 extends between the left and right side members 14 and 15 proximate to the ends 31 and 51. The brace 20 defines a fulcrum, which can be used against the inside of an individual's elbow when the brace 21 or some other part of the apparatus 10 is gripped to provide increased, leveraged force on a body part if so desired. The brace 20 is a fulcrum because it provides a pivot point about which the apparatus 10 can be moved during a massage. The brace 20 includes the top surface 30 which extends across it from the left side member 14 to the right side member 15, and the bottom surface 40, which similarly extends across it between the left and right side members 14 and 15. The brace 20 includes a side face 64, which defines an outer fulcrum face, directed away from the majority of the framework 11. The left and right side members 14 and 15 extend only slightly past the side face 64 of the brace 20 to their ends 31 and 51, thereby bounding and defining an open, U-shaped pocket 65 between the ends 31 and 51 and the side face 64. The side face 64 is slightly convex, bowing outward from the left and right side members 14 and 15. Opposite the side face 64 is a slot 66 formed in the brace 20. The slot 66 extends entirely from the left side member 14 to the right side member 15 and opens vertically between the top and bottom surfaces 30 and 40. The slot 66 extends entirely into the brace 20, and is occupied by the trigger 22. The brace 21, like the brace 20, is formed of, or covered in, a material having a soft and tacky characteristic. This provides both a soft and comfortable grip as well a secure, non-slip grip.

Figure 3A:
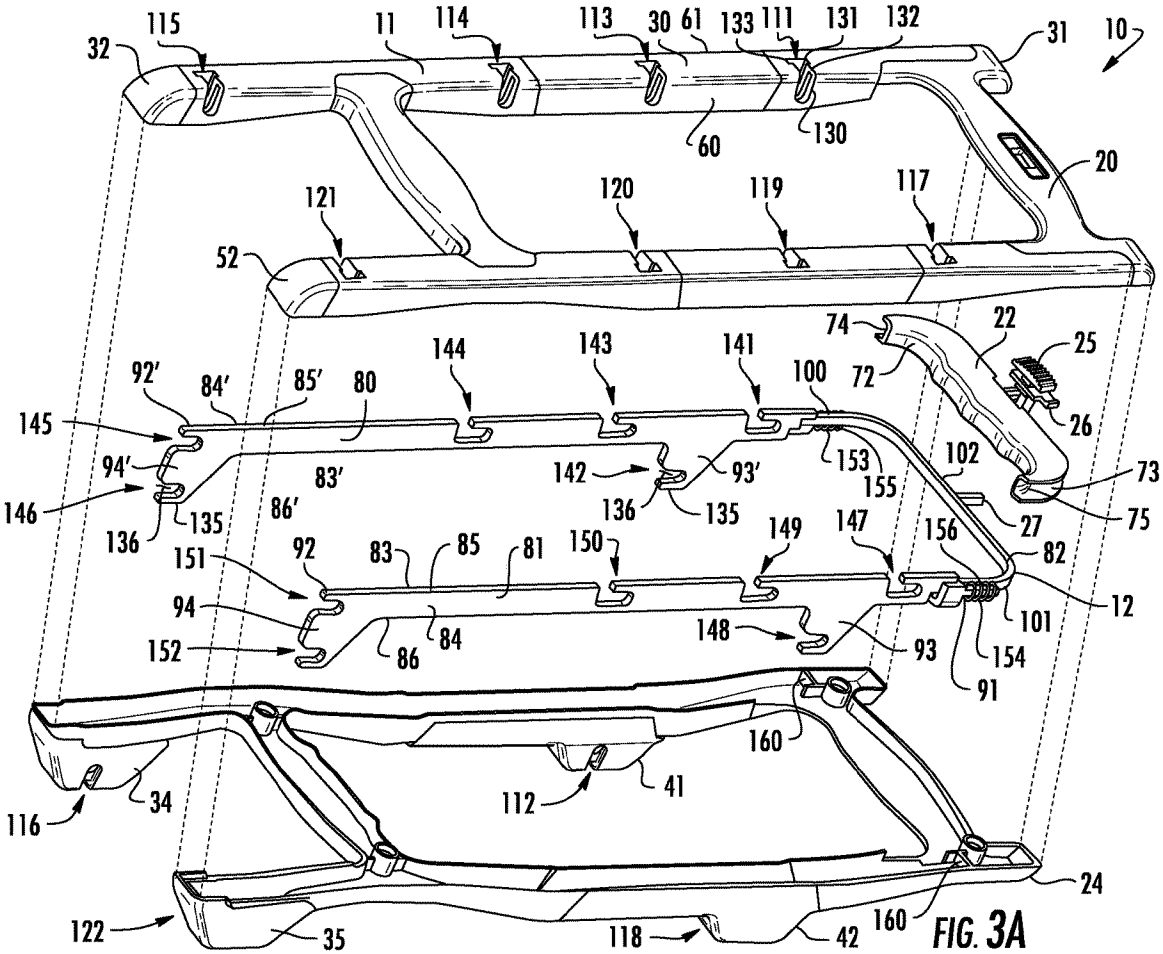
FIG. 3A is a top perspective, exploded view of the apparatus of FIG. 1.

Turning now to FIG. 3A, in addition to FIG. 1, the trigger 22 is a cover that fits over the chassis 12. The trigger 22 is a concave grip having a solid front face 72 and an opposed, open-backed channel 73 into which the chassis rail 12 is seated. The front face 73 has a number of depressions or stalls for receiving fingers when gripped. The channel 73 is wide and coextensive in width with the brace 20, and turns forward at opposed ends 74 and 75 to provide the trigger 22 with its concave shape. The trigger 22 is mounted on the chassis rail 12 and moves between an extended position, shown in FIG. 2A, and a retracted position, shown in FIG. 2B, to impart movement to the chassis rail 12, according to description below.

The apparatus 10 is formed with a safety lock 25, which is a slidable button carried in the brace 20 for reciprocal movement between the left and right side members 14 and 15. The safety lock 25 has a block 26 which depends from the lock 25 into the brace 20. The block 26 is formed with a slotted keyway aligned parallel to the direction of movement of the trigger 22. The chassis rail has a key 27 extending rearwardly. The key 27 is aligned with the block. When the safety lock 25 is slid to one side in a locked position, the key 27 is registered with the block 26. When the safety lock 25 is slid to the other side in an unlocked position, the key 27 is registered with the keyway in the block 26. In the locked position of the safety lock 25, the trigger 22 is prevented from being drawn back: the key 27 encounters the block 26 and is prevented from moving. In the unlocked position of the safety lock 25, the trigger 22 can move back: the key 27 is registered with the keyway and slides into the keyway as the trigger 22 and chassis rail 12 are moved back into the brace 20.

The trigger 22 is fit over and receives a portion of the chassis rail 12. The chassis rail 12 is best seen in the exploded view of FIG. 3A; it extends internally throughout much of the framework 11. The chassis rail 12 has a unique structure to fit within the framework 11 and cooperate with the framework 11 to form the cradles 13 in which the ball assemblies can be received, secured, and released. The chassis rail 12 includes opposed, elongate, left and right rail members 80 and 81 and a tie or bridge 82 extending between the rail members 80 and 81. Preferably, the chassis rail 12 is constructed from a single piece of material, such as plastic and metal, and is formed in a mold such as an injection mold, or is die cut, or is stamped and bent. In some embodiments, however, the left and right rail members 80 and 81 are separate, as is the bridge 82 which is coupled to the rail members 80 and 81.

The rail members 80 and 81 are opposite and identical, and as such, only one will be described here, with the understanding that the description applies equally to the other, except as specifically identified herein. The description will thus treat the right rail member 81, illustrated in the foreground of FIG. 3A. The same reference characters are used to designate the same structural features and elements of the left and right rail members 80 and 81, but the structural features and elements of the left rail member 80 are marked with a prime symbol ("') so as to clearly differentiate them from those of the right rail member 81. The right rail member 81 has opposed inner and outer faces 83 and 84, which are major faces and larger than a top edge 85 and an opposed bottom edge 86. The inner and outer faces 83 and 84 and the top and bottom edges 85 and 86 cooperate to define a body of the right rail member 81. The right rail member 81 extends between a first end 91 and a second end 92, the distance between which is just less than the distance between the first and second ends 51 and 52 of the right side member 15 of the framework 11.

The top edge 85 is generally straight but for a plurality of notches formed into the body of the right rail member 81. The bottom edge 86 is not so configured; proximate to the first end 91, it extends straight and parallel to the top edge 85 and then turns downward at a projection 93 extending down from the top edge 85. The projection 93 corresponds to the minor foot 42. The projection 93 includes a notch. The bottom surface 86 then moves upward and turns rearward to progress straight and parallel to the top edge 85 until the second end 92, where another projection 94 is formed. The projection 94 at the second end 92 corresponds to the major foot 35 in the right side member 15 of the framework 11, and extends downward roughly the same vertical distance as the projection 92, and it includes two notches. Thus, the right rail member 81 has a vertical height which varies between the first and second ends 91 and 92, from relatively short at the first end 91 to tall at the projection 93 to short again between the projections 93 and 94 to finally tall at the projection 94.

As stated above, and still referring to FIG. 3A, the left and right rail members 80 and 81 have identical structural features and elements, but those of the left rail member 80 are designated with the prime symbol and not necessarily marked on the drawings for the sake of the clarity of the illustration. As such, the left rail member 80 includes an inner face 83', an outer face 84', a top edge 85', a bottom edge 86', first and second ends 91' and 92', and two projections 93' and 94'.

The bridge 82 between the left and right rail members 80 and 81 connects the left and right rail members 80 and 81 rigidly so that the left and right rail members 80 and 81 move together in unison and do not flex, slide, or otherwise move independently of each other. The bridge 82 is U-shaped, and has opposed legs 100 and 101 and a back 102 extending therebetween. The legs 100 and 101 are integrally formed to the left and right rail members 80 and 81, in embodiments in which the chassis rail 12 is a monolithic structure. In embodiments in which the chassis rail 12 is assembled from separate pieces, the legs 100 and 101 are fixed and secured, such as with fasteners, welding, sonic welding, or other similar permanent fastening method. The legs 100 and 101 are short in comparison to the wide back 102. The key 27 for preventing the movement of the trigger 22 extends centrally from the back 102 toward the keyway formed in the block 26.

As has been stated above, the framework 11 and the chassis rail 12 cooperate to form a plurality of cradles across the apparatus 10. Returning to FIG. 1, a number of cradles are seen formed into the left side member 14; similar cradles are formed into the right side member 15 in opposing locations as sets or pairs. Each of the locations of the cradles is specific, so as to provide the apparatus 10 with a plurality of unique, disparate arrangements for the ball assemblies. First, third, fourth, and fifth cradles 111, 113, 114, and 115 are formed into the top surface 30 of the left side member 14 and are directed upward to receive a ball assembly from above. Second and sixth cradles 112 and 116 are formed into the bottom surface 31 of the left side member 14 and are directed downward. The first cradle 111 is formed proximate to the first end 31. The second cradle 112 is formed in the minor foot 41. The third cradle 113 is formed just above the minor foot 41. The fourth cradle 114 is formed between the minor foot 41 and the brace 21. The fifth cradle 115 is formed above the major foot 34, and the sixth cradle 116 is formed in the major foot 34. Each of the cradles 111-116 extends into the framework 11 from the inner surface 60 and either of the top surface 30 or the bottom surface 31. The cradles all extend in from the inner surface 60 because the ball assemblies span between the left and right side members 14 and 15 and thus engage with the framework 11 through the inner surface 60.

A number of cradles are formed into the right side member 15. Each corresponds with a cradle formed into the left side member 14, forming a set therewith. Seventh, eighth, ninth, tenth, eleventh, and twelfth cradles 117, 118, 119, 120, 121, and 122 are formed into the right side member 15 and are directed upward to receive a ball assembly therein from above. Eighth and twelfth cradles 118 and 122 are directed downward to receive a ball assembly therein from below. The seventh cradle 117 is formed proximate to the first end 51. The eighth cradle 118 is formed in the minor foot 42. The ninth cradle 119 is formed just above the minor foot 42. The tenth cradle 120 is formed between the minor foot 42 and the brace 21. The eleventh cradle 121 is formed just above the major foot 35. The twelfth cradle 122 is formed in the major foot 35. The eighth and ninth cradles 118 and 122, formed in the minor and major feet 34 and 35, respectively, are not visible in FIG. 1, but the reference characters and arrows show the general location, and one having ordinary skill in the art will readily appreciate and understand that the eighth and ninth cradles 118 and 122 are formed into the minor and major feet 42 and 35 identically and oppositely as the twelfth and sixteenth cradles are formed into the minor and major feet 41 and 34 of the left side member 14.

Each of the cradles 117-122 extends into the framework 11 from inner surface 62 and either the top surface 30 or the bottom surface 31. The cradles 117-122 all extend in from the inner surface 62 because the ball assemblies span between the left and right side members 14 and 15 and thus engage with the framework 11 through the inner surface 62. To accommodate and position the ball assemblies, the cradles are arranged in sets or pairs; each pair includes two oppositely-set cradles. Thus, the first and seventh cradles 111 and 117 form a pair, the second and eighth cradles 112 and 118 form a pair, the third and ninth cradles 113 and 119 form a pair, the fourth and tenth cradles 114 and 120 form a pair, the fifth and eleventh cradles 115 and 121 form a pair, and the sixth and twelfth cradles 116 and 122 form a pair.

Figure 3B:
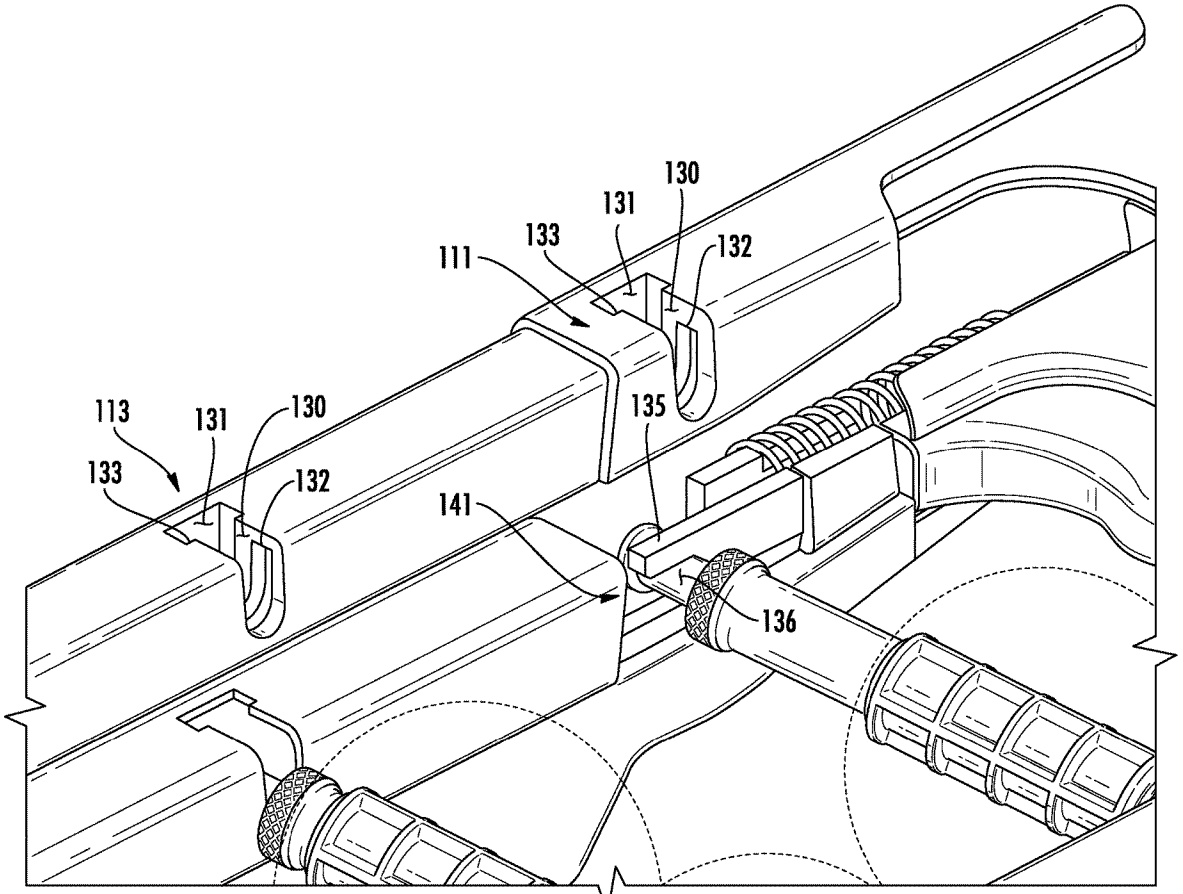
FIG. 3B is an enlarged view of a cradle of the apparatus of FIG. 1.

The cradles are each identical, though located and oriented differently. Referring now primarily to FIG. 3B, the cradles are formed by the framework 11 and the chassis rail 12. The first cradle 111 includes a vertical notch extending downward from the top 30 and through the inner surface 60, terminating a point just above halfway between the top and bottom surfaces 30 and 40. The first cradle 111 is blind to the outer surface 61; it does not pass through or extend to the outer surface 61. The first cradle 111 includes a narrow inner portion 130 formed through the inner surface 60 and an enlarged head 131 inboard of the inner portion 130. The inner portion 130 further includes an axial slot 132 extending lengthwise through the inner portion 130 along a line oriented between the first end 31 and the second end 32. The slot 132 defines an opening for the chassis rail 12 to pass through the first cradle 111, as will be explained. The first cradle 111 is oriented vertically, such that a ball assembly is applied from the top down into the first cradle 111. An outwardly-directed shoulder 133 is defined laterally from the enlarged head 131 to the inner portion 130. The shoulder 133 is a horizontal transition between the larger diameter enlarged head 131 and the smaller diameter inner portion 130. The shoulder 133 further defines an abutment surface.

The chassis rail 12 has a guard 141 which interacts with the first cradle 111 to secure and release a ball assembly. With reference still to FIG. 3B, the guard 141 is formed from a channel cut into the top edge 85' of the left rail member 80 which then turns laterally and cuts along the length of the left rail member 80 between the top and bottom edges 85' and 86', thus defining a jaw 135 and a catch 136 below the jaw 136. Positioned in the framework 11, the guard 141 extends through the first cradle 111, and is moveable in a reciprocating fashion to slide the jaw 135 into and back out of the slot 132, thereby closing and opening the first cradle 111, respectively.

Referring again to FIG. 3A, each of the cradles depending from the top surface 30 of the framework 11 is identical to the first cradle 111. Each of the third cradle 113, fourth cradle 114, fifth cradle 115, seventh cradle 117, ninth cradle 119, tenth cradle 120, and eleventh cradle 121 depend from the top surface 30. Each has the same inner portion 130, enlarged head 131, slot 132, and shoulder 133 as the first cradle 111, and as such, description of each will not be presented here. One having ordinary skill in the art will readily appreciate and understand how such structure is formed and used for the third cradle 113, fourth cradle 114, fifth cradle 115, seventh cradle 117, ninth cradle 119, tenth cradle 120, and eleventh cradle 121. The reference characters 130-136 are not shown in the drawings for those cradles other than the first cradle 111 for cleanliness of the drawings.

Further, the second and sixth cradles 112 and 116 have the identical structure as the first cradle 111 as well, but such structure is flipped in orientation about a horizontal. The second and sixth cradles 112 and 116 each have an inner portion 130, an enlarged head 131, a slot 132, and a shoulder 133, though those numbers are not marked on the drawings for the sake of cleanliness. Like in the first cradle 111, the inner portion 130 of the second cradle 112 is formed through the inner surface 60 and next to the enlarged head 131. However, unlike in the first cradle 111, the inner portion 130 of the second cradle 112 is formed into the framework 11 from the bottom surface 40 of the minor foot 41, and its orientation is thus reversed with respect to the first cradle 111. The sixth cradle 116 is formed and oriented similarly to the second cradle, though in the major foot rather than the minor foot 41. Similarly, the eighth and twelfth cradles 118 and 122 have identical structure as the second and sixth cradles 112 and 116, being formed in the minor and major feet 42 and 35, respectively, but in an opposite orientation on the right side member 15 instead of the left side member 14.

Moreover, there are a number of guards formed across the chassis rail 12. The guard 141 is a first guard 141 corresponding to the first cradle 111. There also is a second guard 142 corresponding to the second cradle 113, a third guard 143 corresponding to the third cradle 113, a fourth guard 144 corresponding to the fourth cradle 114, a fifth guard 145 corresponding to the fifth cradle 115, a sixth guard 146 corresponding to the sixth cradle 116, a seventh guard 147 corresponding to the seventh cradle 117, an eighth guard 148 corresponding to the eighth cradle 118, a ninth guard 149 corresponding to the ninth cradle 119, a tenth guard 150 corresponding to the tenth cradle 120, an eleventh guard 151 corresponding to the eleventh cradle 121, and a twelfth guard 152 corresponding to the twelfth cradled 112. Each of the guards is located through the slot 132 of its corresponding cradle to form a cradle assembly. Each of these guards 142-152 includes the identical structure of the first guard, namely, a jaw 135 and a catch 136.

While most of the guards are formed in-line with the generally straight chassis rail 12, four guards are not. The second guard 142 is formed on the projection 93', the sixth guard 146 is formed on the projection 94', the eighth guard 148 is formed on the projection 93, and the sixth twelfth guard 152 is formed on the projection 94. The second and eighth guards 142 and 148 are identical, formed on opposed projections 93' and 93, respectively. The second guard 142 includes a jaw 135 which defines the lower end of the projection 93', and a catch 136 is just above it, extending into the projection 93' from a vertical rear face thereof. The projection 93 has in the second guards 142 similar structure to eighth cradle 148. The sixth and twelfth guards 146 and 152 are identical, formed on opposed projections 94' and 94, respectively. The sixth guard 146 includes a jaw 135 formed at and defining the lower end of the projection 94' and a catch 136 just above it, extending in to the projection 94' from a vertical rear face. Similarly, the fifth guard 145 extends into the projection 94' from the same vertical face. The projection 94 has in the eleventh and twelfth guards 151 and 152 similar structure to both the fifth and sixth cradles 145 and 146.

The chassis rail 12 is carried in the framework 11 for sliding, reciprocal movement within the framework 11. As seen in FIG. 3A, two springs 153 and 154 are carried on a portion of the chassis rail 12 and bias it into an extended position. The springs 153 and 154 can be compressed to place the chassis rail 12 in a retracted position. The chassis rail 12 includes two posts 155 and 156 which are coupled to the chassis rail 12 generally between the left rail member 80 and the bridge 82 and between the right rail member 81 and the bridge 82. The posts 155 and 156 are short projections or stubs extending toward the first ends 31 and 51, and the springs 153 and 154 are placed onto them. The springs are compressed between the bases of the posts 155 and 156 and two abutment surfaces 160 and 161 within the framework 12. The abutment surfaces 160 and 161 are internal walls that limit the movement of the compression springs 153 and 154 and the sliding movement of the chassis rail 12. Referring now to FIGS. 2A and 2B, which are section views taken along the line 2-2 in FIG. 1, the two positions of the chassis rail 12 are illustrated. FIG. 2A illustrates the extended position of the chassis rail 12, while FIG. 2B illustrates the retracted position of the chassis rail 12.

In FIG. 2A, the trigger 22 is in an extended position. The bridge 82 of the chassis rail 12 is seated into the channel 73 of the trigger 22, thereby coupling the trigger 22 to the chassis rail 12 so that the two move together in synchronous motion. The trigger 22 may in some cases be bonded or adhered to the chassis rail 12 to further secure the coupling between the trigger 22 and the chassis rail 12. When the trigger 22 is in an extended position as in FIG. 2A, the trigger 22 is moved out of the slot 66, toward the brace 20. This occurs when an individual releases the trigger 22, such as would occur when the individual is actively using the apparatus 10 for a massage or the apparatus 10 is stored. The springs 153 and 154, riding on the posts 155 and 156, respectively, are slightly compressed between the bases of the posts 155 and 156 and the abutment faces 160 and 161, respectively, and thus exert an axial force against the chassis rail 12, urging the chassis rail 12 toward the brace 21. When the chassis rail 12 is so urged, each of the cradles 111-122 is closed, because each of the guards 141-152 is moved forward and the jaws 135 are in the slots 132 of the cradles 111-122. The jaws 135 penetrate through the slots 132 to close the cradles 111-122.

FIG. 2B, on the other hand, shows the chassis rail 12 slid back. The trigger 22 is compressed, such as would occur when an individual grips the trigger 22 together with the brace 20 and draws the trigger 22 back against the resistance of the springs 153 and 154. When the trigger 22 is compressed, it is moved into the slot 66, toward the brace 20. The chassis rail 12, being seated in the trigger 22, is moved in the same direction, toward the brace 20. The springs 153 and 154 are greatly compressed, and the posts 155 and 156 which the springs 153 and 154 ride on may in some cases contact or "bottom out" against the abutment faces 160 and 161, respectively. The springs 153 and 154 resist the compression, exerting a force on the chassis rail 12 toward the brace 21. When the chassis rail 12 is moved in this direction toward the brace 20, each of the cradles 111-122 is simultaneously opened and open, because each of the guards 141-152 is moved backward and the jaws 135 are out of the slots 132 of the cradles 111-122. In this way, each of cradles 111-122 has an opening through which a ball assembly can be applied to place the ball assembly in the cradle 111-122.

A unique characteristic of the apparatus 10 is its modularity. The apparatus 10 is used with a large variety of ball assemblies, each of which presents a different massage surface and can be arranged in a different location to provide the individual with a different massage experience. Each of the seven ball assemblies described below is modular, in that each can be disassembled into basic constituent parts such as axles, nuts, and ball units. Those constituent parts can be rearranged in different combinations and permutations to form different assemblies. The seven ball assemblies presented below offer many different assemblies. It is noted, however, that each of the below seven embodiments has a "fixed" analog in which the constituent parts are integral parts or are fixed together. In this fixed analog, the axle, nuts, hubs, and balls are formed integrally and monolithically as a single piece, so that an individual can purchase and apply a pre-assembled ball assembly without having to assemble or build it.

Figure 4A:
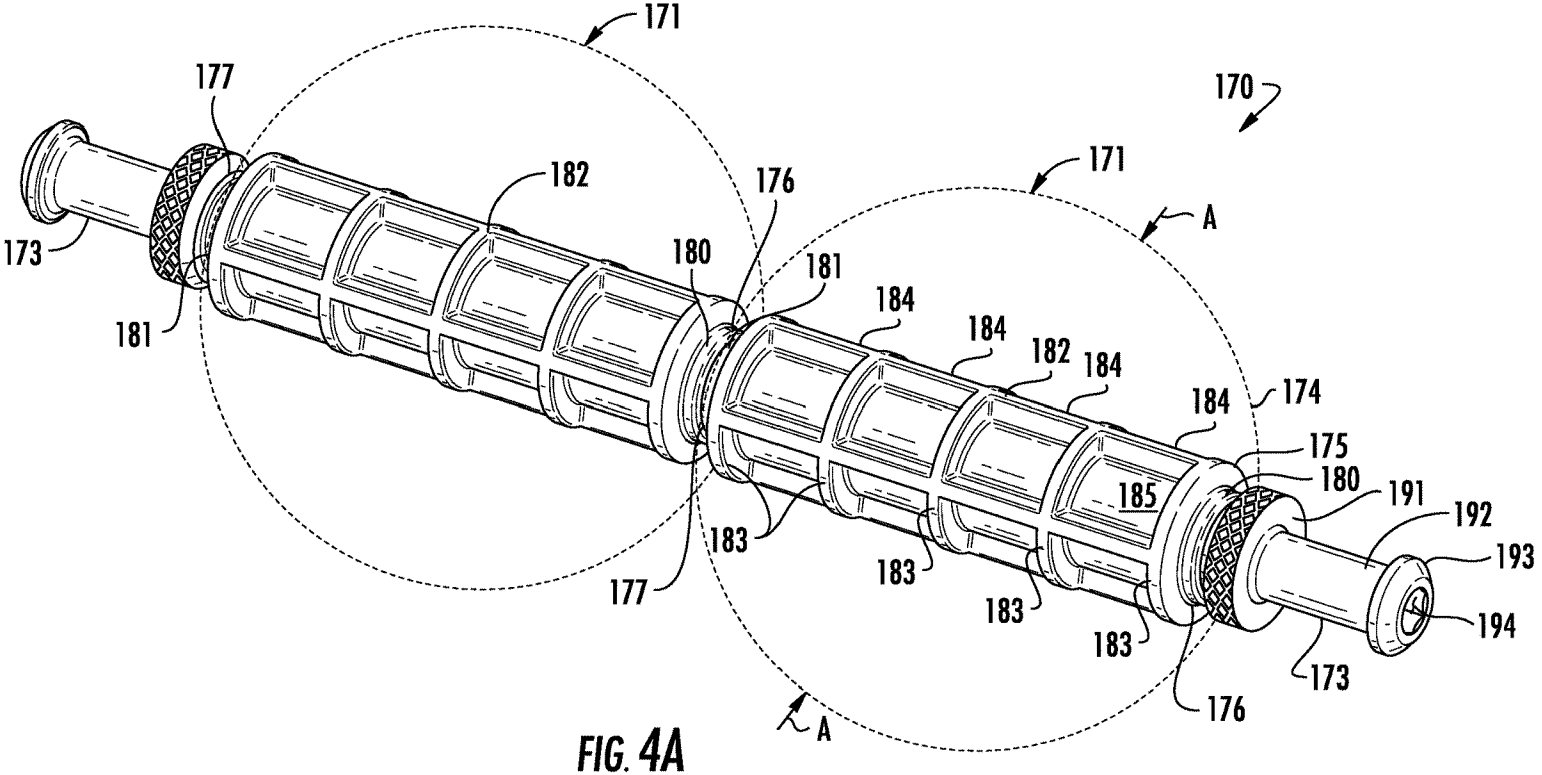
FIGS. 4A-4C are top perspective views of other embodiments of modular ball assemblies for use in the apparatus of FIG. 1.
Figure 4B:
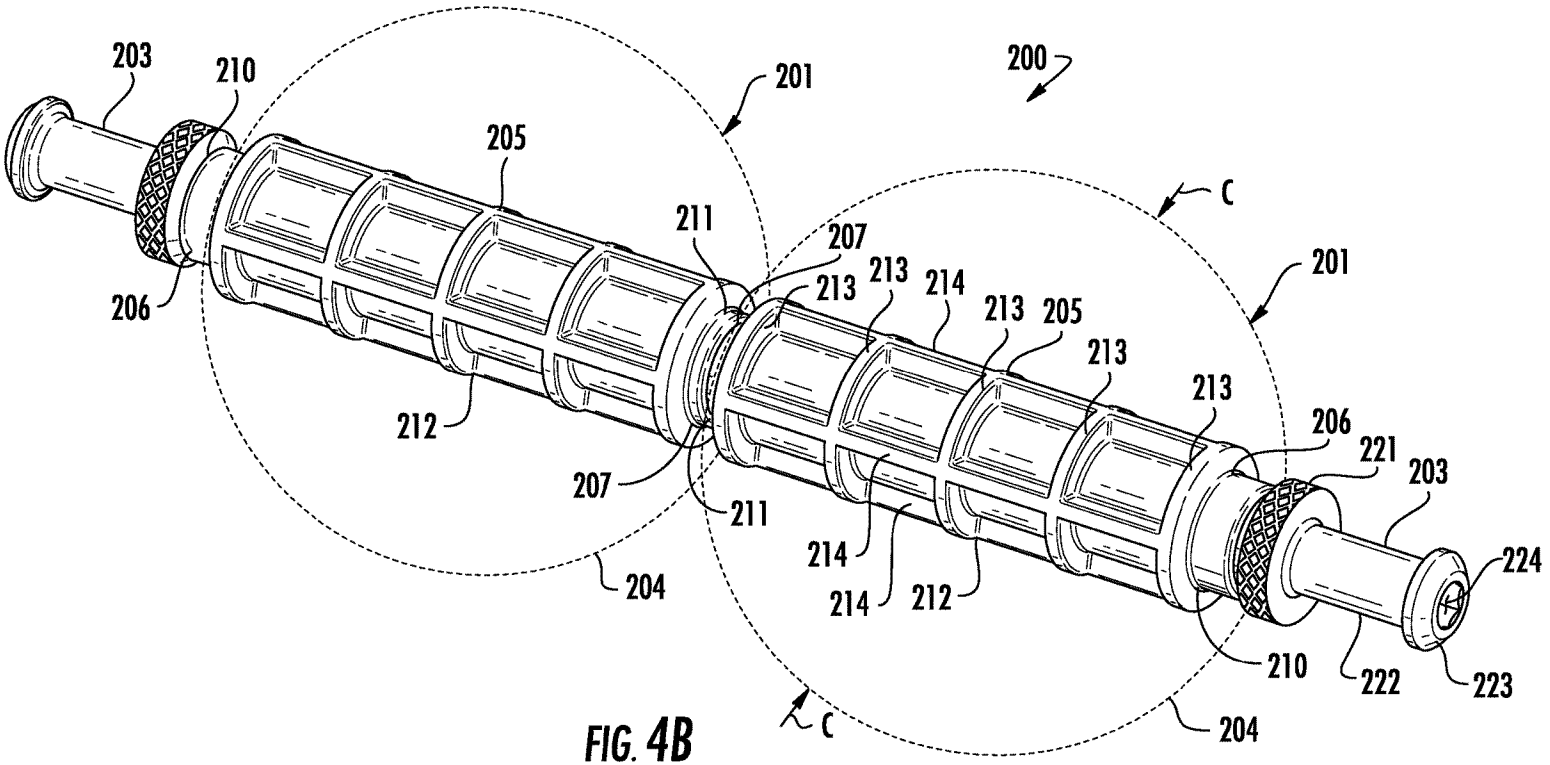
Figure 4C:
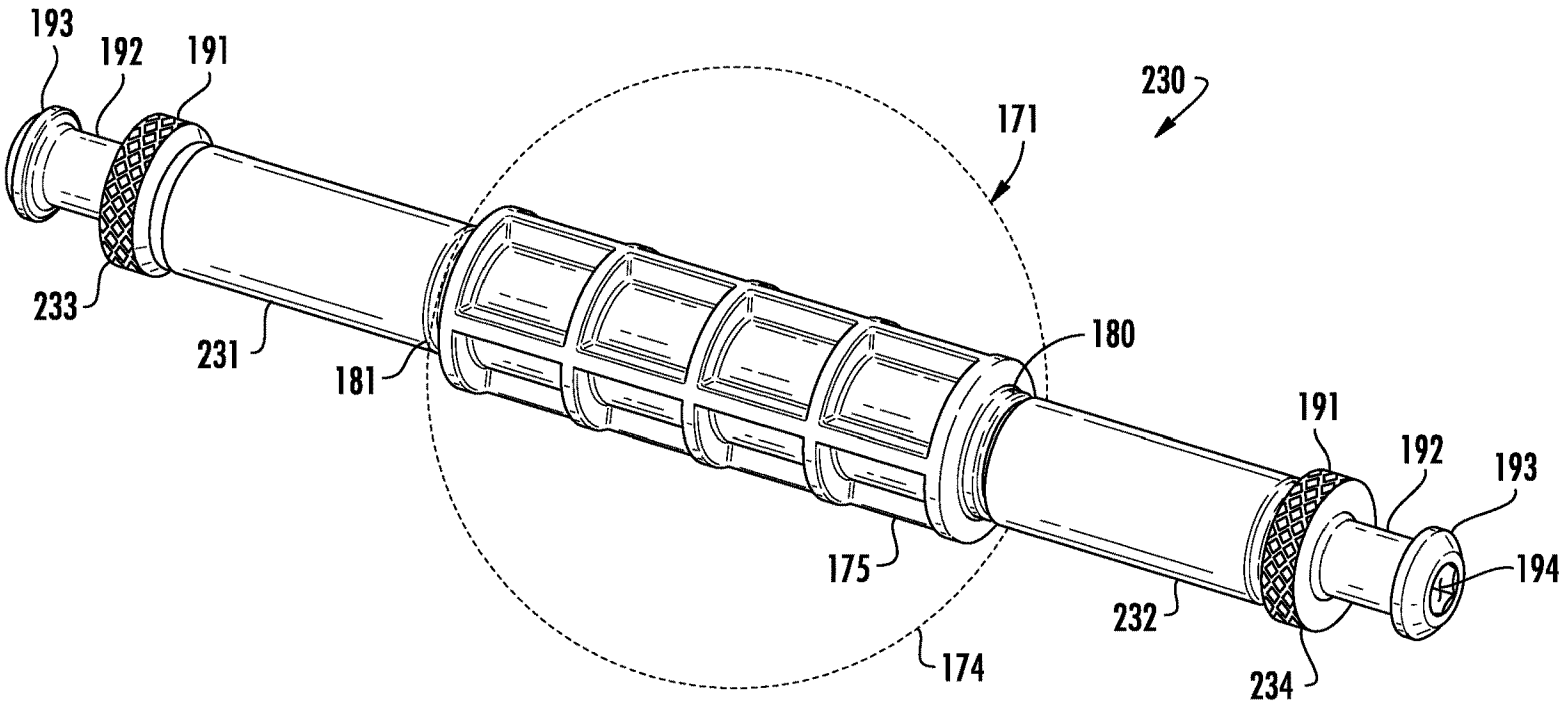
Figure 4D:
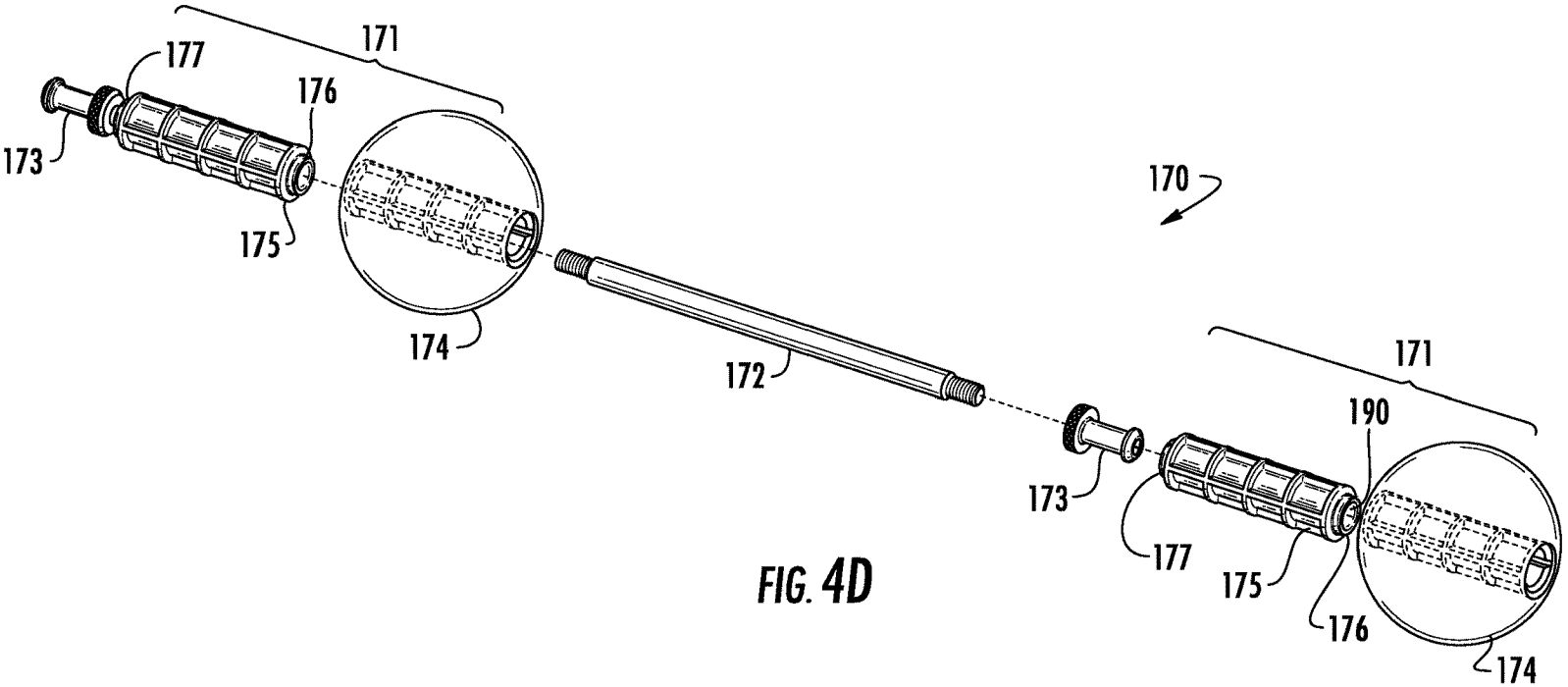
FIG. 4D is a top perspective, exploded view of the ball assembly FIG. 4A.

A first ball assembly 170 is shown in FIG. 4A and FIG. 4D. The first ball assembly 170 includes two identical ball units 171 mounted together, side-by-side on a single axle 172 between two nuts 173. Both the ball units 171 and the axle 172 are modular, such that they can be removed, replaced, and arranged in different fashions as will be described. Each ball unit 171 is a ball 174 carried on a hub 175. The ball 174 is formed integrally to the hub 175 in that it is preferably applied during manufacture and injection-molded over, heat-bonded, heat-shrunk, adhered, or otherwise bonded to the hub 175 such that the ball 174 cannot be removed from the hub 175 without causing substantial damage to the ball 174. The balls 174 are fairly compressible and yield under light loads. The balls 174 preferably have a Shore hardness value of between approximately 0026 and approximately 0052. The balls 174 are identical and have a diameter A as indicated in FIG. 4A.

While the balls 174 are compressible, the hubs 175 are very rigid. Both hubs 175 can be seen in FIG. 4A as the balls 174 are drawn in broken or hidden line, and in the exploded view of FIG. 4D, the hubs 175 are shown clearly. The hubs 175 are identical, and as such, only one hub 175 will be described. The hub 175 is generally long and cylindrical, having opposed first and second ends 176 and 177. The hub 175 has rotational symmetry about an axis, and is symmetric about a central plane bifurcating the hub 175; thus, the first and second ends 176 and 177 are opposite and identical. Axially-extending first and second flanges 180 and 181 project outward from a body 182 at the first and second ends 176 and 177, respectively. The flanges 180 and 181 have reduced diameters with respect to the diameter of the body 182 of the hub 175. The ball 174 is seated entirely over the body 182 of the hub 175, but the flanges 180 and 181 extend axially beyond the surface of the ball 174 a distance. The body 182 of the hub 175, contained and hidden within the ball 174, is formed with a plurality of corrugations or square depressions. Several continuous annular ribs 183 are spaced apart axially across the body 182, with a first annular rib 183 at the first end 176, a last annular rib 183 at the second end 177, and three annular ribs 183 spaced therebetween. One having ordinary skill in the art will appreciate that there may be slightly more or fewer annular ribs 183 in other embodiments. Intersecting those annular ribs 183, a plurality of axial ribs 184 are spaced apart annularly from each other. The axial ribs 184 extend axially entirely from the first annular rib 183 at the first end 176 to the last annular rib 183 at the second end 177. Both of the annular and axial ribs 183 and 184 project radially above a hub surface 185. The ball 174, again, is seated on the hub 175, such that the body of the ball 174 is formed over the annular ribs 183, over the axial ribs 184, and over the hub surface 185. The square depressions formed into the body 182 by the axial and annular ribs 183 and 184 prevent relative rotational and axial movement of the ball 174 on the hub 175. The balls 174 are compressible and thus would otherwise be susceptible to being deformed or rotated off of the hub surface 185.

The hub 175 is mounted for free rotation on the axle 172, so that the ball unit 171 is mounted for free rotation with respect to the axle 172. The hub 175 has a central bore 190, seen only in FIG. 4D, that extends entirely through the hub 175 in an axial direction. The bore 190 is just larger than the axle 172, and rides in rotation on the axle 172 in a plain bearing arrangement. The ends of the axle 172 are threaded to receive the nuts 173. The nuts 173 allow the first ball assembly 170 to rotate within a cradle when applied to the framework 11.

Referring to FIG. 4A, the nuts 173 secure and hold the ball units 171 on the axle 172 to maintain the first ball assembly 170 as a single piece. The nuts 173 are identical, and the description will refer only to one nut 173. The nut 173 has an enlarged base 191, a shank 192, and a head 193 opposed from the base 191. The shank 192 has a reduced diameter with respect to both the base 191 and the head 193. The base 191 has a larger diameter than the head 193. The base 191 and head 193 act as delimiters, as will be described. The outer circumference of the base 191 is knurled, and the head 193 is formed with a socket 194, such as would accept an allen wrench. The nut 173 is threaded onto the threaded end of the axle 172, thereby securing the nut 173 on the axle 172. The knurled base 191 allows an individual to easily grab and quickly rotate and threadably engage the nut 173 onto the axle 172, and the socket 194 allows an individual to use a tool—such as an allen wrench—to threadably engage the nut 173 onto the axle 172, where dexterity may not otherwise permit adequate threading and tightening.

The nuts 173 are used to cap the axle 172 at opposed ends. The nuts 173 contain the ball units 171 on the axle 172 and prevent lateral or axial movement of the ball units 171 thereon. FIG. 4A clearly shows two ball units 171 mounted to the axle 172. The balls 174 of the ball units 171 are spaced apart from each other by the first and second flanges 180 and 181 in between the balls 174. The balls 174 are also spaced apart from the nuts 173 by the first and second flanges 180 and 181 at the first and second ends 176 and 177. The first and second flanges 180 and 181 are plain bearings, allowing rotational movement of the ball units 171 with respect to the nuts 173 and with respect to each other. Indeed, because the balls 174 yield and compress under force during a massage, they bulge axially. And the balls 174 have a tacky or slightly adhesive quality. However, because the balls 174 are spaced apart by the first and second flanges 180 and 181, the balls 174 are prevented from rubbing against each other and or binding.

When so assembled, the first ball assembly 170 is ready for application into and use with the apparatus 10. The shanks 192 of the nuts 173 releasably engage with the cradles 13 to secure the first ball assembly 170 as part of the apparatus 10. Returning to FIG. 1, the first ball assembly 170 is shown applied to the framework 11 between the left and right side members 14 and 15. The first ball assembly 170 thus spans the gap between the left and right side members 14 and 15, and the ball units 171 are thus disposed in the air, free, and able to be rotated without interference. The nut 173 at the first end 176 of the hub 175 is fit into the ninth cradle 119, and the nut 173 at the second end 177 of the hub 175 is fit into the third cradle 113. The third and ninth cradles 113 and 119 are shown in FIG. 1 closed, or in the closed position, such that the first ball assembly 170 cannot be removed from the apparatus 10.

The enlarged base 191 on the nut 173 at the first end 176 of the hub 175 is placed in contact with the inner face 83 of the right rail member 81. The shank 192 is fit into the catch 136 of the ninth guard 149, disposed in the slot 132 of the inner portion 130 of the ninth cradle 119. The catch 136 is sized and shaped to closely receive the shank 192 to prevent jiggling or other loose movements, but not rotation. The shank 192 extends further into the ninth cradle 119, terminating with the head 193 disposed in the enlarged head 131 of the ninth cradle 119. The enlarged head 131 of the ninth cradle 119 is sized and shaped to closely receive the head 193 of the nut 173 to prevent loose movements. This engagement prevents the first ball assembly 170 from moving laterally (axially), vertically, and horizontally. The base 191 abuts the inner face 83 of the right rail member 81 and is thus prevented from moving laterally (axially) outward out of the framework 11. The jaw 135 of the ninth guard 149 limits vertical movement of the shank 192, thereby preventing the first end 176 from rising up out of the ninth cradle 119. The ninth guard 149 and the framework 11 also limit vertical movement of the shank 192, preventing the first end 176 from moving downward. The close fits of the shank 192 in the ninth guard 149 and the head 131 in the ninth cradle 119 similarly prevent the first end 176 from moving horizontally in forward or rearward directions. Thus, the first end 176 of the hub 175 is securely restrained by cooperation of the ninth cradle 119 and the ninth guard 149, so that the first ball assembly 170 cannot move with respect to the framework 11 other than in free rotation.

Just as the nut 173 at the first end 176 of the hub 175 is secured by cooperation of the ninth cradle 119 and the ninth guard 149, so is the nut 173 at the second end 177 of the hub 175 secured by cooperation of the third cradle 113 and the third guard 143. Still referring to FIG. 1, the nut 173 at the second end 177 of the hub 175 is fit into the third cradle 113.

The enlarged base 191 on the nut 173 at the second end 177 of the hub 175 is placed in contact with the inner face 80 of the right rail member 80. The shank 192 is fit into the catch 136 of the third guard 143, disposed in the slot 132 of the inner portion 130 of the third cradle 113. The catch 136 is sized and shaped to closely receive the shank 192 to prevent jiggling or other loose movements, but not rotation. The shank 192 extends further into the third cradle 113, terminating with the head 193 disposed in the enlarged head 131 of the third cradle 113. The enlarged head 131 of the third cradle 113 is sized and shaped to closely receive the head 193 to prevent loose movements. This engagement prevents the first ball assembly 170 from moving laterally (axially), vertically, and horizontally. The base 191 abuts the inner face 80 of the right rail member 80 and is thus prevented from moving laterally (axially) outward out of the framework 11. The jaw 135 of the third guard 143 limits vertical movement of the shank 192, thereby preventing the second end 177 from rising up out of the third cradle 113. The third guard 143 and the framework 11 also limit vertical movement of the shank 192, preventing the second end 177 from moving downward. The close fits of the shank 192 in the third guard 143 and the head 131 in the third cradle 113 similarly prevent the second end 177 from moving horizontally in forward or rearward directions. Thus, the second end 177 of the hub 175 is securely restrained by cooperation of the third cradle 113 and the third guard 143, so that the first ball assembly 170 cannot move with respect to the framework 11 other than in free rotation.

Turning to FIG. 2A, the nuts 173 in the third and ninth guards 143 and 149 can be seen more clearly. Here, the third and ninth cradles 113 and 119 are closed. The trigger 22 is in the advanced position, the chassis rail 12 is in the closed position, and the first ball assembly 170 is seated and secured in the framework 11. When the individual desires to remove the first ball assembly 170, he pulls or draws back on the trigger 22 to move the trigger 22 into the retracted position, thereby moving the chassis rail 13 into the retracted position. When the chassis rail 13 is in the retracted position, each of the cradles 13 are moved into the open position, as shown in FIG. 2B. The jaws 135 of the third and ninth guards 143 and 149 are drawn back into the framework 11 and out of the slots 132, thereby opening the third and ninth cradles 113 and 119. The first ball assembly 170 can now be removed vertically from the apparatus 10 simply by grasping the first ball assembly 170 and pulling upward along line B. In this way, the first ball assembly 170 is removed, and the apparatus is left with a void extending between the third and ninth cradles. The individual now has the option to leave this void empty, such as may be necessary for a different massage arrangement, or insert a new ball assembly for another different massage arrangement.

Referring now to FIG. 4B, a second ball assembly 200 is shown. The second ball assembly 200 is very similar in appearance to the first ball assembly 170 but includes a unique characteristic different from the first ball assembly 170. In the second ball assembly, the balls are offset within the ball units, providing the individual with the ability to rearrange the ball units to position the balls differently.

The second ball assembly 200 includes two identical ball units 201 mounted together, side-by-side on a single axle between two nuts 203. Both the ball units 201 and the axle are modular, such that they can be removed, replaced, and arranged in different fashions as will be described. The ball unit 201 is a ball 204 carried on a hub 205. The ball 204 is formed integrally to the hub 205 in that it is preferably applied during manufacture and injection-molded over, heat-bonded, heat-shrunk, adhered, or otherwise bonded to the hub 205 such that the ball 204 cannot be removed from the hub 205 without causing substantial damage to the ball 204. The balls 204 are fairly compressible and yield under light loads. The balls 204 are opposite and identical and have a diameter C as indicated in FIG. 4B. Diameter C is equal to the diameter A of the balls 174 in the first ball assembly 170.

While the balls 204 are compressible, the hubs 205 are very rigid. Both hubs 205 can be seen in FIG. 4B since the balls 204 are drawn in broken line. The hubs 205 are identical, and as such, only one hub 205 will be described. The hub 205 is generally long and cylindrical, having opposed first and second ends 206 and 207. The hub 205 has rotational symmetry about an axis. Axially-extending first and second flanges 210 and 211 project outward from a body 212 at the first and second ends 206 and 207, respectively. The flanges 210 and 211 have reduced diameters with respect to the diameter of the body 212 of the hub 205. The flanges are different in axial length: the flange 210 is larger than the flange 211. The flange 210 is preferably twice as long in an axial direction as the flange 211. In other embodiments, that ratio is larger. The ball 204 is seated entirely over the body 212 of the hub 205, but the flanges 210 and 211 extend axially beyond the surface of the ball 204 a distance. The body 212 of the hub 205, contained and hidden within the ball 204, is formed with a plurality of corrugations or square depressions. Several continuous annular ribs 213 are spaced apart axially across the body 212, with a first annular rib 213 at the first end 206, a last annular rib 213 at the second end 207, and three annular ribs 213 spaced therebetween. One having ordinary skill in the art will appreciate that there may be slightly more or fewer annular ribs 213 in other embodiments. Intersecting those annular ribs 213, a plurality of axial ribs 214 are spaced apart annularly from each other. The axial ribs 214 extend axially entirely from the first annular rib 213 at the first end 206 to the last annular rib 213 at the second end 207. Both of the annular and axial ribs 213 and 214 project radially above a hub surface 215. The ball 204, again, is seated on the hub 205, such that the body of the ball 204 is formed over the annular ribs 213, over the axial ribs 214, and over the hub surface 215.

The hub 205 is mounted for free rotation on the axle 202, so that the ball unit 201 is mounted for free rotation with respect to the axle 202. The hub 205 has a central bore, not seen in FIG. 4B but similar to the bore 190 of the hub 185 shown in FIG. 4B, that extends entirely through the hub 205 in an axial direction. The bore is just larger than the axle 202, and rides in rotation on the axle 202 in a plain bearing arrangement. The ends of the axle 202 are threaded to receive the nuts 203.

Referring still to FIG. 4B, the nuts 203 secure and hold the ball units 201 on the axle 202 to maintain the ball assembly 200 as a single piece. The nuts 203 are identical, and the description will refer only to one nut 203. Further, the nuts 203 are virtually identical to the nuts 173, but are referenced here separately for clarity; in this embodiment, the nuts 203 may be of a slightly different size to the nuts 203, though otherwise are identical. The nut 203 has an enlarged base 221, a shank 222, and a head 223 opposed from the base 221. The shank 222 has a reduced diameter with respect to both the base 221 and the head 223. The base 221 has a larger diameter than the head 223. The base 221 and head 223 act as delimiters, as will be described. The outer circumference of the base 221 is knurled, and the head 223 is formed with a socket 224, such as would accept an allen wrench. The nut 203 is threaded onto the threaded end of the axle 202, thereby securing the nut 203 on the axle 202. The knurled base 221 allows an individual to easily grab and quickly rotate and threadably engage the nut 203 onto the axle 202, and the socket 224 allows an individual to use a tool—such as an allen wrench—to threadably engage the nut 203 onto the axle 202, where dexterity may not otherwise permit adequate threading and tightening.

The nuts 203 are used to cap the axle 202 at opposed ends. The nuts 203 contain the ball units 201 on the axle 202 and prevent lateral or axial movement of the ball units 201 thereon. FIG. 4B clearly shows two ball units 201 mounted to the axle 202. The balls 204 of the ball units 201 are spaced apart from each other by the first and second flanges 210 and 211 in between the balls 204. The balls 204 are also spaced apart from the nuts 203 by the first and second flanges 210 and 211 at the first and second ends 206 and 207. The first and second flanges 210 and 211 are plain bearings, allowing rotational movement of the ball units 201 with respect to the nuts 203 and with respect to each other. Indeed, because the balls 204 yield and compress under force during a massage, they bulge axially. And the balls 204 have a tacky or slightly adhesive quality. However, because the balls 204 are spaced apart by the first and second flanges 210 and 211, the balls 204 are prevented from rubbing against each other and or binding.

As can be seen in FIG. 4B, the second ends 207 of the hubs 205 of the ball units 201 oppose and are against each other. Because the flanges 211 at the second ends 207 are twice as long axially as the flanges 210 at the first ends 205, the balls 204 of the ball units 201 are spaced apart by a comparatively large gap. However, should the individual decide that a smaller gap be needed or desired for a specific massage technique, he merely needs to remove one of the caps 203 by threadably dis-engaging it from the axle 202, sliding the ball units 201 off the axle 202, and flipping one or both of the ball units 201. If one ball unit 201 is flipped in orientation, such that the first end 206 of one ball unit 201 is against the second end 207 of another ball unit 201, the gap is reduced to three-fourths of its original size. If both ball units 201 are flipped in orientation, such that the first ends 206 are against each other, then the gap is reduced to one-half of its original size. In this way, the individual can create one of several unique massage arrangements with the same two ball units 201.

When so assembled in one of these arrangements, the second ball assembly 200 is ready for application into and use with the apparatus 10. The shanks 222 of the nuts 203 releasably engage with the cradles 13 to secure the second ball assembly 200 as part of the apparatus 10. Returning to FIG. 1, the second ball assembly 200 of the embodiment shown in FIG. 4B is applied to the framework 11 between the left and right side members 14 and 15. The second ball assembly 200 spans the gap between the left and right side members 14 and 15, and the ball units 201 are thus disposed in the air, free, and able to be rotated without interference. The nut 203 at the first end 206 of the hub 205 is fit into the tenth cradle 120, and the nut 203 at the first end 206 of the hub 205 is fit into the fourth cradle 124, so that the balls 105 are spaced apart by a large gap and offset toward the left and right side members 14 and 15, respectively. The fourth and tenth cradles 113 and 119 are shown in FIG. 1 closed, or in the closed position, such that the second ball assembly 200 cannot be removed from the apparatus 10.

The enlarged base 221 on the nut 203 at the first end 206 of the hub 205 is placed in contact with the inner face 83 of the right rail member 81. The shank 222 is fit into the catch 136 of the tenth guard 150, disposed in the slot 132 of the inner portion 130 of the tenth cradle 120. The catch 136 is sized and shaped to closely receive the shank 222 to prevent jiggling or other loose movements. The shank 222 extends further into the tenth cradle 120, terminating with the head 223 disposed in the enlarged head 131 of the tenth cradle 120. The enlarged head 131 of the tenth cradle 120 is sized and shaped to closely receive the head 223 to prevent loose movements. This engagement prevents the second ball assembly 200 from moving laterally (axially), vertically, and horizontally. The base 221 abuts the inner face 83 of the right rail member 81 and is thus prevented from moving laterally (axially) outward out of the framework 11. The jaw 135 of the tenth guard 150 limits vertical movement of the shank 222, thereby preventing the first end 206 from rising up out of the tenth cradle 120. The tenth guard 150 and the framework 11 also limit vertical movement of the shank 222, preventing the first end 206 from moving downward. The close fits of the shank 222 in the tenth guard 150 and the head 131 in the tenth cradle 120 similarly prevent the first end 206 from moving horizontally in forward or rearward directions. Thus, the first end 206 of the hub 205 is securely restrained by cooperation of the tenth cradle 120 and the tenth guard 150.

Just as the nut 203 at the first end 206 of the hub 205 for the "right" ball unit 201 is secured by cooperation of the tenth cradle 120 and the tenth guard 150, so is the nut 203 at the first end 206 of the hub 205 of the "left" ball unit 201 secured by cooperation of the fourth cradle 113 and the fourth guard 143. Still referring to FIG. 1, the nut 203 at the first end 206 of the hub 205 is fit into the fourth cradle 113.

The enlarged base 221 on the nut 203 at the first end 206 of the hub 205 is placed in contact with the inner face 80 of the right rail member 80. The shank 222 is fit into the catch 136 of the fourth guard 143, disposed in the slot 132 of the inner portion 130 of the fourth cradle 113. The catch 136 is sized and shaped to closely receive the shank 222 to prevent jiggling or other loose movements, but not free rotation of the second ball assembly 200. The shank 222 extends further into the fourth cradle 113, terminating with the head 223 disposed in the enlarged head 131 of the fourth cradle 113. The enlarged head 131 of the fourth cradle 113 is sized and shaped to closely receive the head 223 to prevent loose movements. This engagement prevents the second ball assembly 200 from moving laterally (axially), vertically, and horizontally. The base 221 abuts the inner face 80 of the right rail member 80 and is thus prevented from moving laterally (axially) outward out of the framework 11. The jaw 135 of the fourth guard 143 limits vertical movement of the shank 222, thereby preventing the first end 206 from rising up out of the fourth cradle 113. The fourth guard 143 and the framework 11 also limit vertical movement of the shank 222, preventing the first end 206 from moving downward. The close fits of the shank 222 in the fourth guard 143 and the head 131 in the fourth cradle 113 similarly prevent the first end 206 from moving horizontally in forward or rearward directions. Thus, the first end 206 of the hub 205 is securely restrained by cooperation of the fourth cradle 113 and the fourth guard 143, so that the second ball assembly 200 cannot move with respect to the framework 11 other than in free rotation.

Turning to FIGS. 1 and 2A, the nuts 203 in the fourth and tenth cradles 114 and 120 can be seen more clearly. Here, the fourth and tenth cradles 114 and 120 are closed. The trigger 22 is in the advanced position, the chassis rail 12 is in the closed position, and the second ball assembly 200 is seated and secured in the framework 11. When the individual desires to remove the second ball assembly 200, he pulls or draws back on the trigger 22 to move the trigger 22 into the retracted position, thereby moving the chassis rail 13 into the retracted position. When the chassis rail 13 is in the retracted position, each of the cradles 13 are moved into the open position, as shown in FIG. 2B. The jaws 135 of the fourth and tenth guards 144 and 150 are drawn back into the framework 11 and out of the slots 132, thereby opening the fourth and tenth cradles 114 and 120. The second ball assembly 200 can now be removed vertically from the apparatus 10 simply by grasping the second ball assembly 200 and pulling upward along the same line B as for the first ball assembly 170. In this way, the second ball assembly 200 is removed, and the apparatus 10 is left with a void extending between the fourth and tenth cradles 114 and 120. The individual now has the option to leave this void empty, such as may be necessary for a different massage arrangement, or insert a new ball assembly for another different massage arrangement.

Figure 4E:
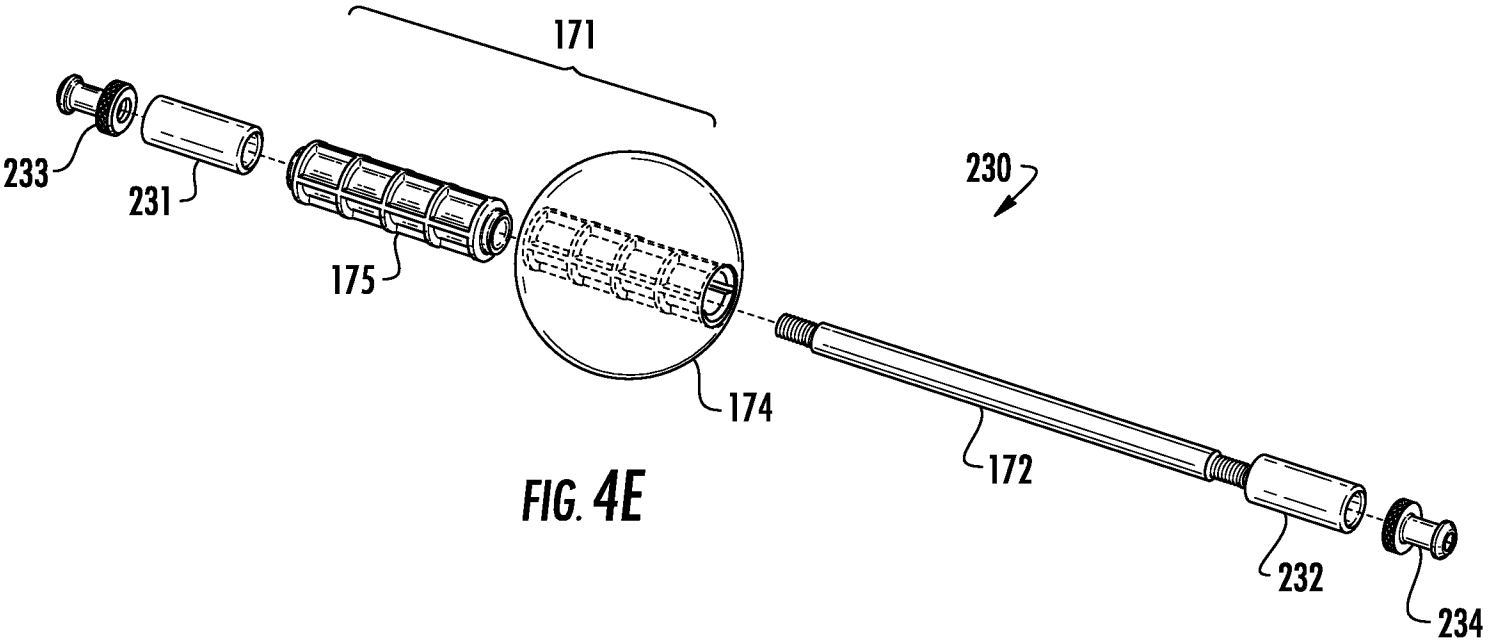
FIG. 4E is a top perspective, exploded view of the ball assembly of FIG. 4C.

Referring now to FIGS. 4C and 4E, a third ball assembly 230 is shown. The third ball assembly 230 uniquely includes only a single central ball. However, the third ball assembly 230 is formed by some of the same structural elements and features as the first and second ball assemblies 170 and 200. As such, those same structural elements and features will be identified with the reference characters used with respect to the first and second ball assemblies 170 and 200, to emphasize that the parts are the same. Therefore, much of the description of those same structural elements and features need not be repeated here. Despite some of the similar parts, the third ball assembly 230 employs some different parts, thus providing the individual with yet another arrangement for a unique massage.

The third ball assembly 230 includes the single ball unit 171 mounted between left and right spacers 231 and 232 on the single axle 172 (shown in FIG. 4E only). The ball unit 171 includes the ball 174 carried on the hub 175.

The left and right spacers 231 and 232 flank the sides of the ball unit 171 in the third ball assembly 230. The left and right spacers 231 and 232 are each long and cylindrical, having ends which are opposed and identical. The left and right spacers 231 and 232 each have rotational symmetry about an axis and are symmetric about a central bifurcating plane. The left and right spacers 231 and 232 have lengths roughly two-thirds the diameter A of the ball 174.

The left and right spacers 231 and 232 are in plain bearing contact with the first and second flanges 180 and 181 of the hub 175. The left spacer 231 is in contact with the second flange 181, and the right spacer 232 is in contact with the first flange 180. The first and second flanges 180 and 181 are identical and equal in size, so that the ball unit 171 is symmetric about a central plane perpendicular to its axis.

Left and right nuts 233 and 234 secure and hold the ball unit 171 and the left and right spacers 231 and 232 on the axle 172. The left and right nuts 233 and 234 are identical to each other and to the nuts 173, but are given their own reference character here so as to more easily differentiate the orientation of the third ball assembly 230 when applied in the apparatus 10. It should be clearly understood, however, that the left and right nuts 233 and 234 are identical to the nuts 173. As such, the left and right nuts 233 and 234 each have a base 191, a shank 192, a head 193, and a socket 194. The nuts 233 and 234 are threaded onto the axle 172 at opposed thereof to prevent lateral or axial movement of the ball unit 171 and the left and right spacers 231 and 232 thereon. As a result, during use, the ball 174 maintains its central position in the third ball assembly 230.

When so assembled, the third ball assembly 230 is ready for application into and use with the apparatus 10. Exactly as the nuts 173 engage with the cradles 13, so do the left and right nuts 233 and 234 engage with the cradles 13. FIG. 1 shows two instances of the third ball assembly 230 engaged at opposed ends of the apparatus 10. One of the third ball assemblies 230 is shown applied to the framework 11 between the left and right side members 14 and 15 spanning the gap therebetween, and thus disposing its ball unit 171 in the air, free, and able to be rotated without interference. The left nut 233 is fit into the first cradle 111, and the right nut 234 is fit into the seventh cradle 117. The other of the third ball assemblies 230 is also shown applied to the framework 11 between the left and right side members 14 and 15 spanning the gap therebetween, and thus disposing its ball unit 171 in the air, free, and able to be rotated without interference. That third ball assembly 230 extends between the fifth cradle 115 and eleventh twelfth cradle 121. Each of these cradles is closed in FIG. 1.

Application of the first and second ball assemblies 170 and 200 to the apparatus 10, and removal therefrom, has been described at length above. The third ball assembly 230 is applied, secured, removed in a similar manner, and as such, need not be explained again. One having ordinary skill in the art will readily appreciate that the same process is used, substituting the first and seventh cradles 111 and 117 for those in the description of the first and second ball assemblies 170 and 200. It is, of course, worth noting that, just as with the first and second ball assemblies 170 and 200, the third ball assembly 230 can be placed in any set of opposing cradles 13 across the apparatus 10.

Figure 4F:
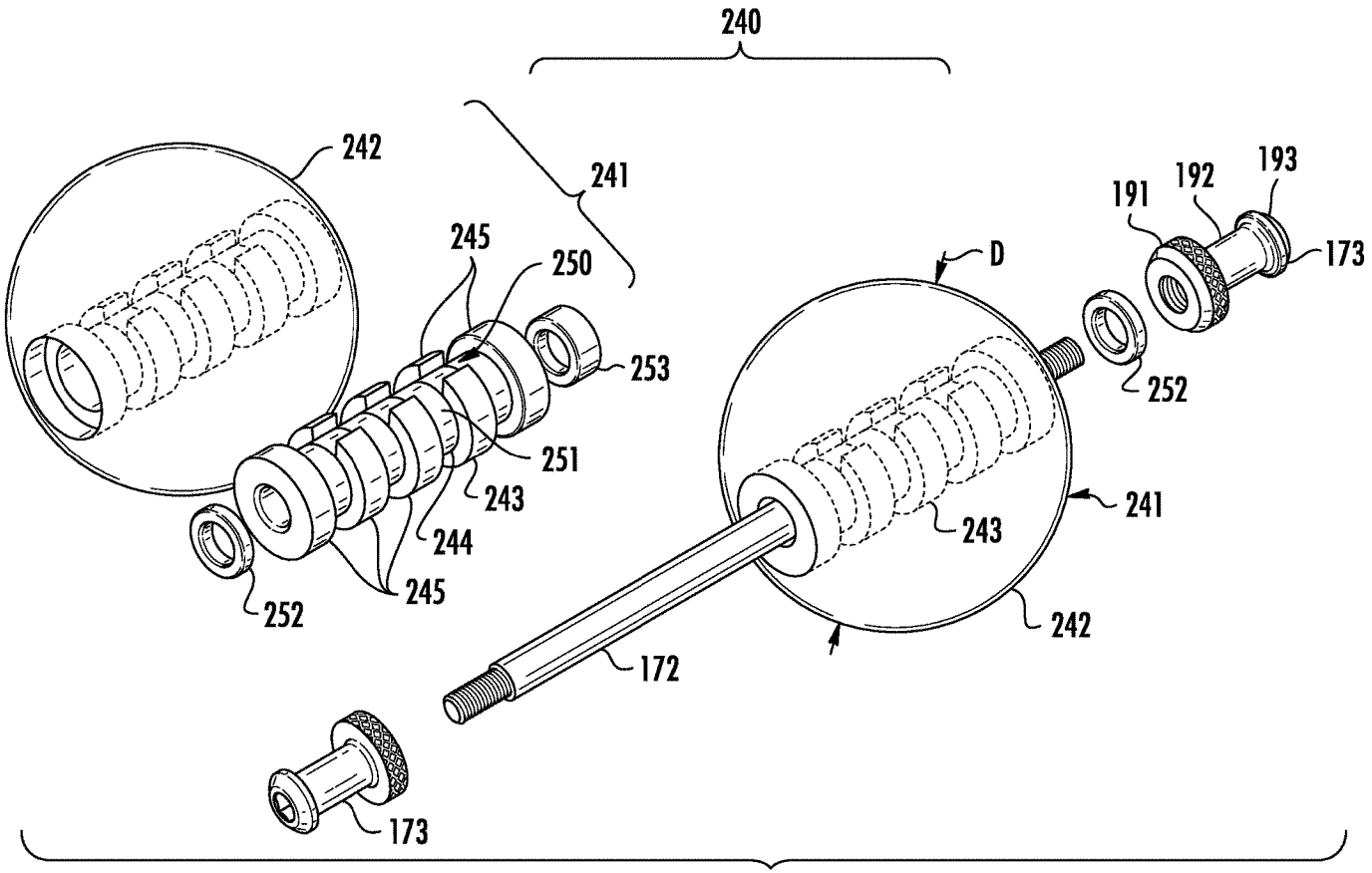
FIGS. 4F and 4G are top perspective, exploded views of still other embodiments of modular ball assemblies for use in the apparatus of FIG. 1.

Turning now to FIG. 4F, a fourth ball assembly 240 is shown. FIG. 4F illustrates a partially exploded view of the fourth ball assembly 240 with one ball unit on the axle 172 and one ball unit off the axle in an exploded state. The fourth ball assembly 240 exploits a two-ball arrangement with a different hub that in the ball units 171. The fourth ball assembly 240 includes two identical ball units 241 mounted together on the single axle 172 between spacers and two nuts 173. The ball unit 241 is a ball 242 carried on a hub 243. The ball 242 is formed integrally to the hub 243 in that it is preferably applied during manufacture and injection-molded over, heat-bonded, heat-shrunk, adhered, or otherwise bonded to the hub 243 such that the ball 242 cannot be removed from the hub 243 without causing substantial damage to the ball 242. The balls 242 are fairly compressible and yield under light loads. The balls 242 are identical and have a diameter D just less than the diameter A of the balls 174.

While the balls 242 are compressible, the hubs 243 are very rigid. The hubs 243 are identical, and as such, only one hub 243 will be described. The hub 243 is generally long and cylindrical, having ends which are opposite and identical. The hub 243 has rotational symmetry about an axis, and is symmetric about a central plane bifurcating the hub 243. The ends are flush with the outer surface of the ball 242 such that no flange or portion of the hub 243 extends beyond the ball 242. The ball 242 is seated entirely over a body 244 of the hub 243. The body 244 of the hub 243, contained and hidden within the ball 242, is formed with a plurality of spaced-part annular ribs 245 are spaced apart axially across the body 244, with a first annular rib 245 at the one end, a last annular rib 245 at the opposed end, and three annular ribs 245 spaced therebetween. One having ordinary skill in the art will appreciate that there may be slightly more or fewer annular ribs 245 in other embodiments. The first and last annular ribs 245 are continuous. The inner three annular ribs 245, however, are severed. A longitudinal, or axial, groove or channel 250 extends entirely through each of the annular ribs 245, forming a wedge-shaped void in each of the annular ribs 245 common in radial orientation among the annular ribs 245. The channel 250 extends from the outer face of the ribs 245 to a hub surface 251. The ball 242, again, is seated on the hub 243, such that the body of the ball 242 is formed over the annular ribs 245 and over the hub surface 251. The axial channel 250 ensures that the ball 242 stays secured on the hub 243; it prevents relative rotational movement of the ball 242 and the hub 243.

The hub 243 is mounted for free rotation on the axle 172, so that the ball unit 241 is mounted for free rotation with respect to the axle 172. Two types of spacers are also mounted on the axle 172 for free rotation. Two washers 252 are carried on the axle 172, and a single short spacer 253 is as well. In the embodiment shown in FIG. 4F, the washers 252 are located between each ball unit 241 and its proximate nut 173 and provide a plain bearing surface therebetween. The short spacer 253 is located between the two ball units 241 and provides a plan bearing surface therebetween. The short spacer 253 is sufficiently wide to prevent the balls 242 from rubbing against each other and binding.

The nuts 173 secure and hold the two washers 252, the two ball units 241, and the short spacer 253 on the axle 172 to maintain the fourth ball assembly 240 as a single piece. The nuts 173 are identical to those used with the other ball assemblies. They prevent lateral or axial movement of the components on the axle 172.

FIG. 1 does not illustrate the fourth ball assembly 240 applied to the apparatus 10. However, application to and removal from the apparatus 10 is the same for the fourth ball assembly 240 as it is for the first, second, and third ball assemblies 170, 200, and 230, and as such, no further explanation is necessary. Because the fourth assembly 240 is built on the same axle 172 and capped with the same nuts 173, it should be understood that the fourth ball assembly 240 can be placed in any of the sets of opposing cradles 13 across the apparatus 10, just as the first, second, and third assemblies 170, 200, and 230 can be.

Figure 4G:
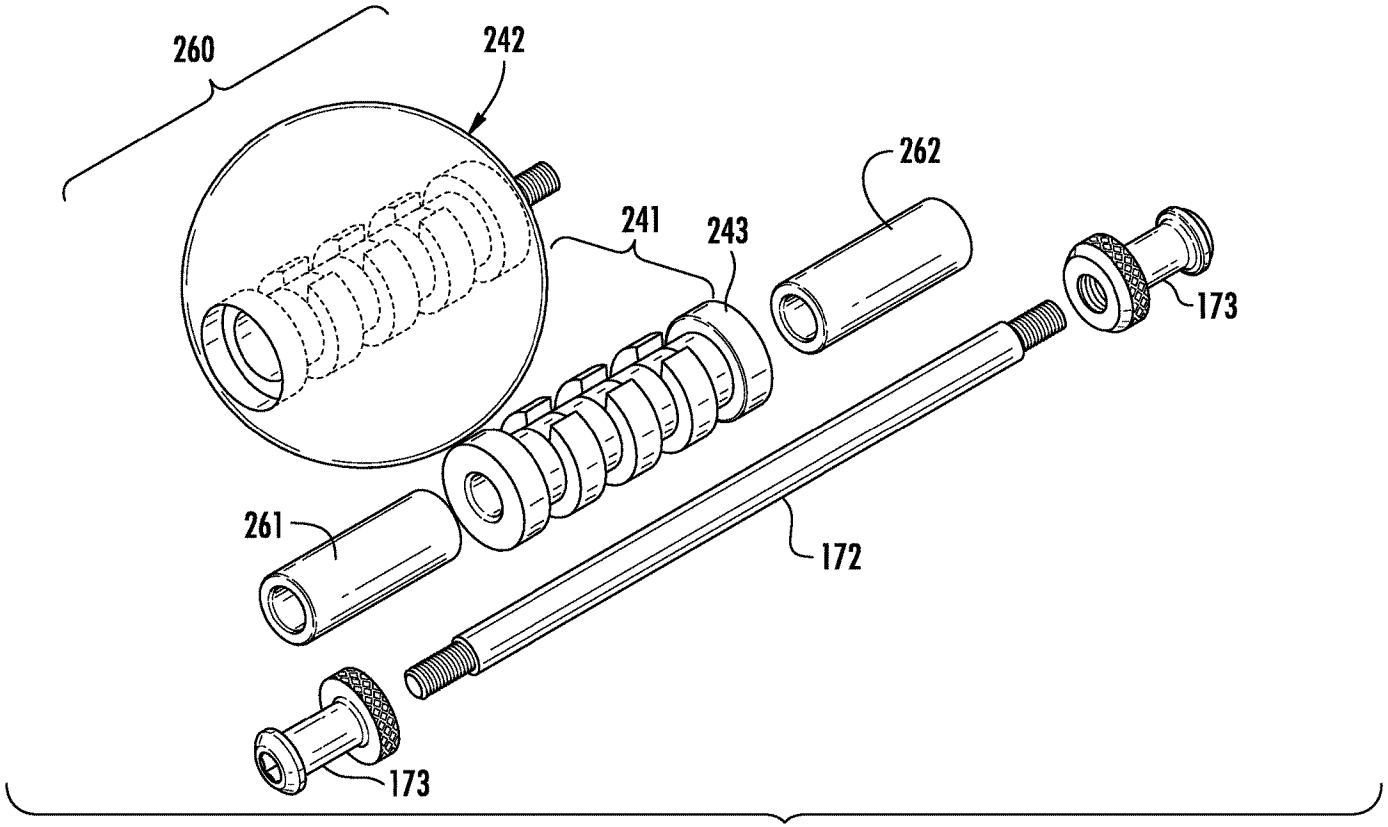

Turning now to FIG. 4G, a fifth ball assembly 260 is shown. FIG. 4G shows the fifth ball assembly 260 in an exploded view. The fifth ball assembly 260 is similar to the fourth ball assembly 240 but has only a single central ball rather than two balls on the axle 172. Indeed, the fifth ball assembly 260 includes the same ball unit 241 used in the fourth ball assembly 240, and thus includes the same ball 242 and hub 243. The hub 243 has the body 244, the annular ribs 245, and the channel 250. The ball unit 241 is mounted on the axle 172.

Identical left and right spacers 261 and 262 flank the hub 243 on either side. The left and right spacers 261 and 262 are very similar to the left and right spacers 231 and 232 of the third ball assembly 230. The left and right spacers 261 and 262 are long and cylindrical, and are disposed between the hub 243 of the ball unit 241 and each of the nuts 271. The left and right spacers 261 and 262 each have rotational symmetry about an axis and are symmetric about a central bifurcating plane. The left and right spacers 261 and 262 have lengths roughly two-thirds the diameter D of the ball 242. The left and right spacers 261 and 262 are in plain bearing contact with the hub 243.

FIG. 1 does not illustrate the fifth ball assembly 260 applied to the apparatus 10. However, FIG. 1 does show the similar third ball assembly 230, which also has only a single central ball, applied to the apparatus 10. Application to and removal from the apparatus 10 is the same for the fifth ball assembly 260 as it is for this third ball assembly 230, and indeed is the same as for the first, second, and fourth ball assemblies 170, 200, and 240. Because the fifth ball assembly 260 is built on the same axle 172 and capped with the same nuts 173, it should be understood that the fifth ball assembly 260 can be placed in any of the sets of opposing cradles 13 across the apparatus, just as the other ball assemblies 170, 200, 230, and 240 can be.

Figure 4H:
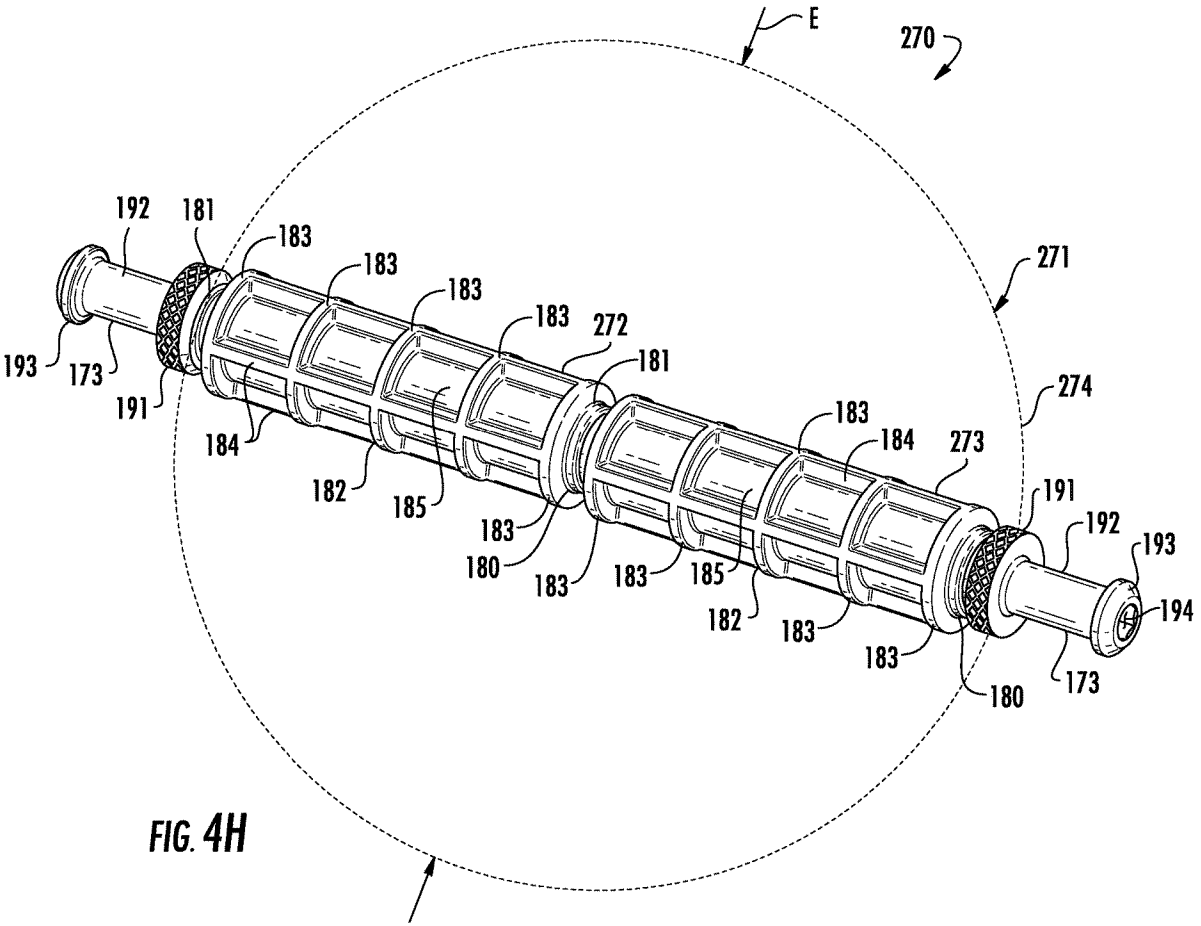
Figure 41:
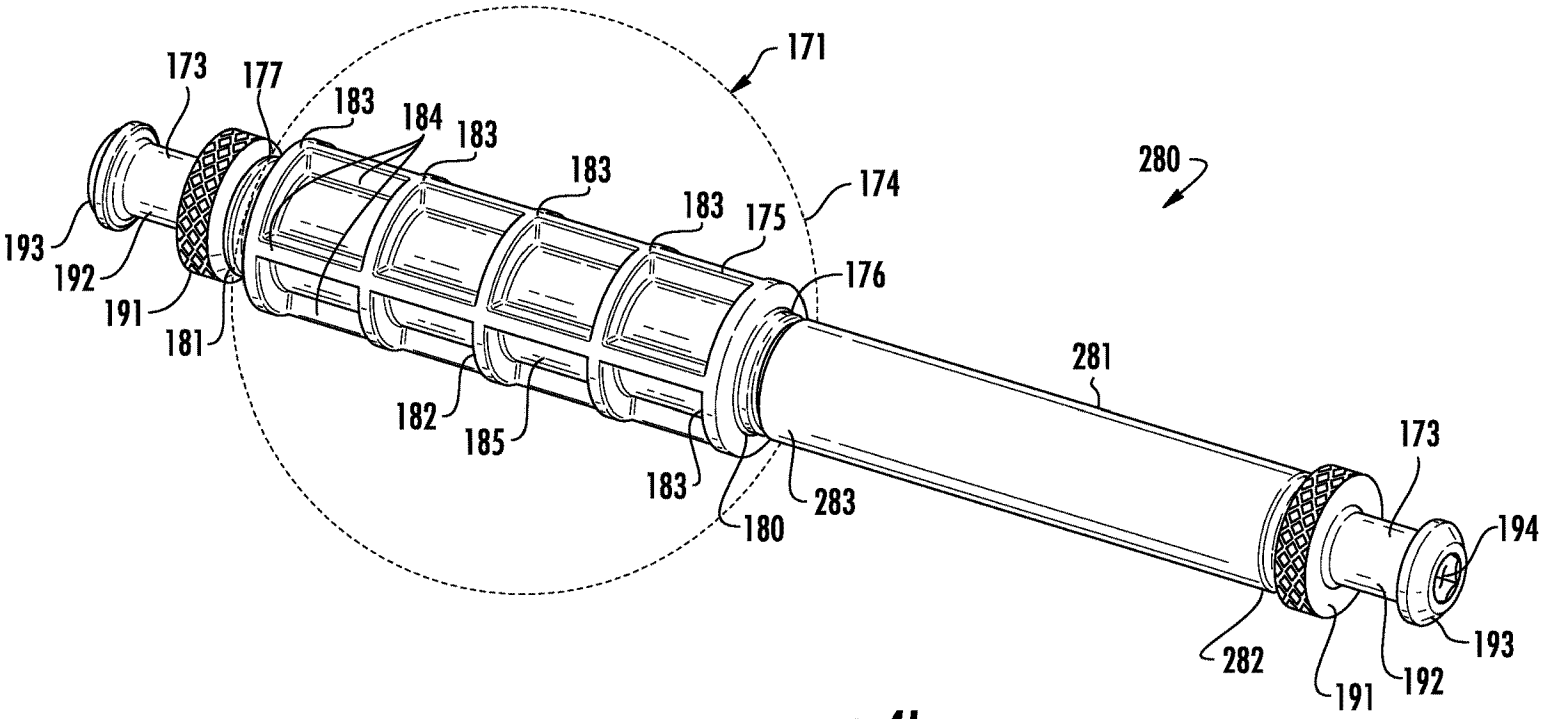

FIG. 4H illustrates a sixth ball assembly 270. The sixth ball assembly 270 is unique because it provides one large ball having a diameter that occupies nearly the entire axle. The sixth ball assembly 270 includes one ball unit 271 including two adjacent hubs 272 and 273 and a ball 274 mounted over both of the hubs 272 and 273. The ball 274 is formed integrally to the hubs 272 and 273 in that it is preferably applied during manufacture and is injection-molded over, heat-bonded, heat-shrunk, adhered, or otherwise bonded to the hubs 272 and 273 such that the ball 274 cannot be removed from the hubs 272 and 273 without causing substantial damage to the ball 274. The ball 274 has a large diameter E as indicated in FIG. 4H.

The ball 274, like the other balls in the other ball assemblies, is preferably fairly compressible. However, the sixth ball assembly 270 is unique in that a large, hard single ball can provide effective trigger point massage therapy. The hubs 272 and 273 are rigid. The hubs 272 and 273 identical to each other and to the hub 175 of the first ball assembly 170. Thus, only the hub 272 is described here, and it is described with the same structural features and elements, and the same reference characters corresponding to those features and elements, as the hub 175. Therefore, the hub 272 includes axially-extending first and second flanges 180 and 181 at opposed first and second ends, respectively, of the hub 272. However, because the hubs are nested within the ball 274, only the first end 180 of the hub 273 extends beyond the surface of the ball 274, and only the second end 181 of the opposed hub 272 extends beyond the surface of the ball 274.

The body 182 of the hub 272 is formed with a plurality of corrugations or square depressions created by the intersection of the several annular ribs 183 with the several axial ribs 184 projecting above the hub surface 185. The square depressions formed into the body by the axial and annular ribs 183 and 184 prevent relative rotational and axial movement of the ball 274 on the hub 175.

The hubs 272 and 273 are mounted for free rotation on the axle 172 (not shown in FIG. 4H but identically located as in the other ball assemblies), so that the hubs 272 and 273 are mounted for free rotation with respect to the axle 172. The hubs 272 and 273 rotate together so that the ball 274 rotates about the axle 172 evenly across its diameter without torsion. The ball unit 271 is prevented from lateral movement on the axle 172 by the nuts 173, each of which has the knurled base 191, shank 192, head 193, and socket 194. The first and second flanges 180 and 181 on the hubs 273 and 272, respectively, are plain bearings against the nuts 173, allowing rotational movement of the ball unit 271 with respect to the nuts 173.

FIG. 1 does not illustrate the sixth ball assembly 270 applied to the apparatus 10. However, FIG. 1 does show the similar third ball assembly 230, which has only a single, yet small, central ball, applied to the apparatus 10. Application to and removal from the apparatus 10 is the same for the sixth ball assembly 270 as it is for this third ball assembly 230, and indeed is the same as for the first, second, fourth, and fifth ball assemblies 170, 200, 240, and 260. Because the sixth ball assembly 270 is built on the same axle 172 and capped with the same nuts 173, it should be understood that the sixth ball assembly 270 can be placed in any of the sets of opposing cradles 13 across the apparatus, just as the other ball assemblies 170, 200, 230, 240, and 260 can be. Moreover, it is especially noted that the diameter of the ball 274 is sufficiently large that it occupies generally the entire gap between the left and right side members 14 and 15 when applied to nay of the sets of cradles 13. Nevertheless, the ball 274 is still disposed in the air, free, and able to be rotated without interference, because of the height of the major and minor feet 34, 35, 41, and 42.

Referring now to FIG. 4I, a seventh ball assembly 280 is shown. The seventh ball assembly 280 uniquely has a ball offset from center along the axle 172. The seventh ball assembly 280 is formed by most of the same structural elements and features as the first ball assembly 170. The seventh ball assembly 280 includes the single ball unit 171 mounted adjacent to a large spacer 281. The single ball unit 171 includes the ball 174 mounted on the hub 175. The hub 175 has the opposed first and second flanges 180 and 181 at the opposed first and second ends 176 and 177, respectively.

The spacer 281 has opposed ends 282 and 283. The spacer 281 is long and cylindrical, and the opposed ends 282 and 283 are symmetric. The spacer 281 has rotational symmetry about an axis and is symmetric about a central bifurcating plane. The spacer 281 has a length approximately equal to the diameter A of the ball 174. The end 283 is in plan bearing contact with the first end 180 of the ball unit 171. Because both the ball unit 171 and the spacer 281 are symmetric, however, they are modular, and the end 282 can be placed against the first or second ends 180 and 181 of the ball unit 171, or the end 283 can be placed against the second end 181 of the hub 181, depending on how the individual arranges the seventh ball assembly 280. The spacer 281 and hub 175 are plain bearings against the nuts 173, which cap the axle 172 and prevent lateral movement of the spacer 281 and hub 175 on the axle 172.

FIG. 1 does not illustrate the seventh ball assembly 280 applied to the apparatus 10. Application to and removal from the apparatus 10 is the same for the seventh ball assembly 280 as it is for all other ball assemblies. Because the seventh ball assembly 280 is built on the same axle 172 and capped with the same nuts 173, it should be understood that the seventh ball assembly 280 can be placed in any of the sets of opposing cradles 13 across the apparatus, just as the other ball assemblies can be. Moreover, it is noted that the seventh ball assembly provides the unique arrangement of an offset ball to provide a different massage arrangement. Further, the seventh ball assembly 280 can be rearranged to place the ball 174 on the other side of the axle 172, or the entire seventh ball assembly 280 can simply be flipped in orientation on the apparatus 10 to place the ball 174 proximate the left or side member 14 and 15, as the individual may desire.

Figure 4J:
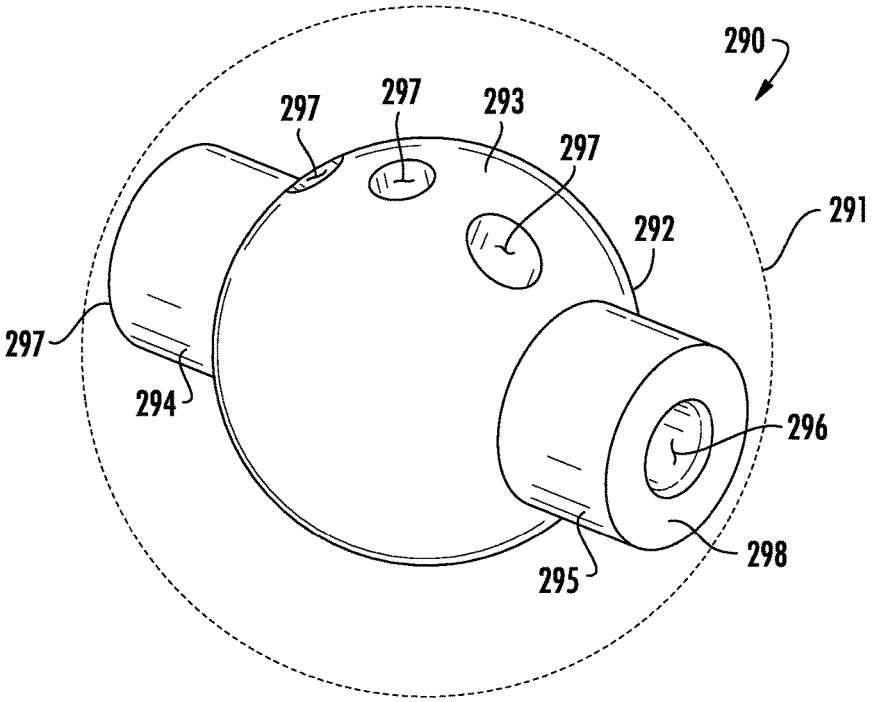
FIG. 4J is a top perspective view of an embodiment of a ball for use in any of the ball assemblies of FIGS. 4A-4I.

Turning now to FIG. 4J, a ball unit 290 is shown. The ball unit 290 is suitable for use in any of the first, second, third, fourth, fifth, sixth or seventh ball assemblies 170, 200, 230, 240, 260, 270, and 280, just as any of the balls of those ball assemblies are modular and may be swapped into and out of the other ball assemblies. The ball unit 290 includes a ball 291 carried on a hub 292. The ball 291 is formed integrally to the hub 292 and is applied during manufacture, such as by injection-molding, heat bonding, heat shrinking, adhering, or otherwise bonding to the hub 292 such that the ball 291 cannot be removed from the hub 292 without causing substantial damage to the ball 292. The ball 291 is fairly compressible and yields under light loads.

The hub 292, in contrast, is rigid. It is uniquely formed, including a central orb 293 and two projecting lobes 294 and 295. The orb 293 and lobes 294 and 295 are formed integrally to each other, monolithically, as a single piece. A bore 296 extends coaxially and entirely through the orb 293 and the lobes 294 and 295. The orb 293 is a globe having rotational symmetry. On opposed sides of the orb 293, the lobes 294 and 295 extend radially outward oppositely from each other. Three holes 297 are formed into the orb 293, defining a plane together with the lobes 294 and 295. The three holes 297 improve cure rates and manufacture times of the ball unit 290, and prevents the relative rotational movement of the ball 291 with respect to the hub 292. The lobes 294 and 295 are each cylindrical projections from the orb 292 terminating in ends 297 and 298, respectively. The ends 297 and 298 are formed coextensively to the surface of the ball 291; each is disposed flush with the surface of the ball 291, but is flat.

Figure 5A:
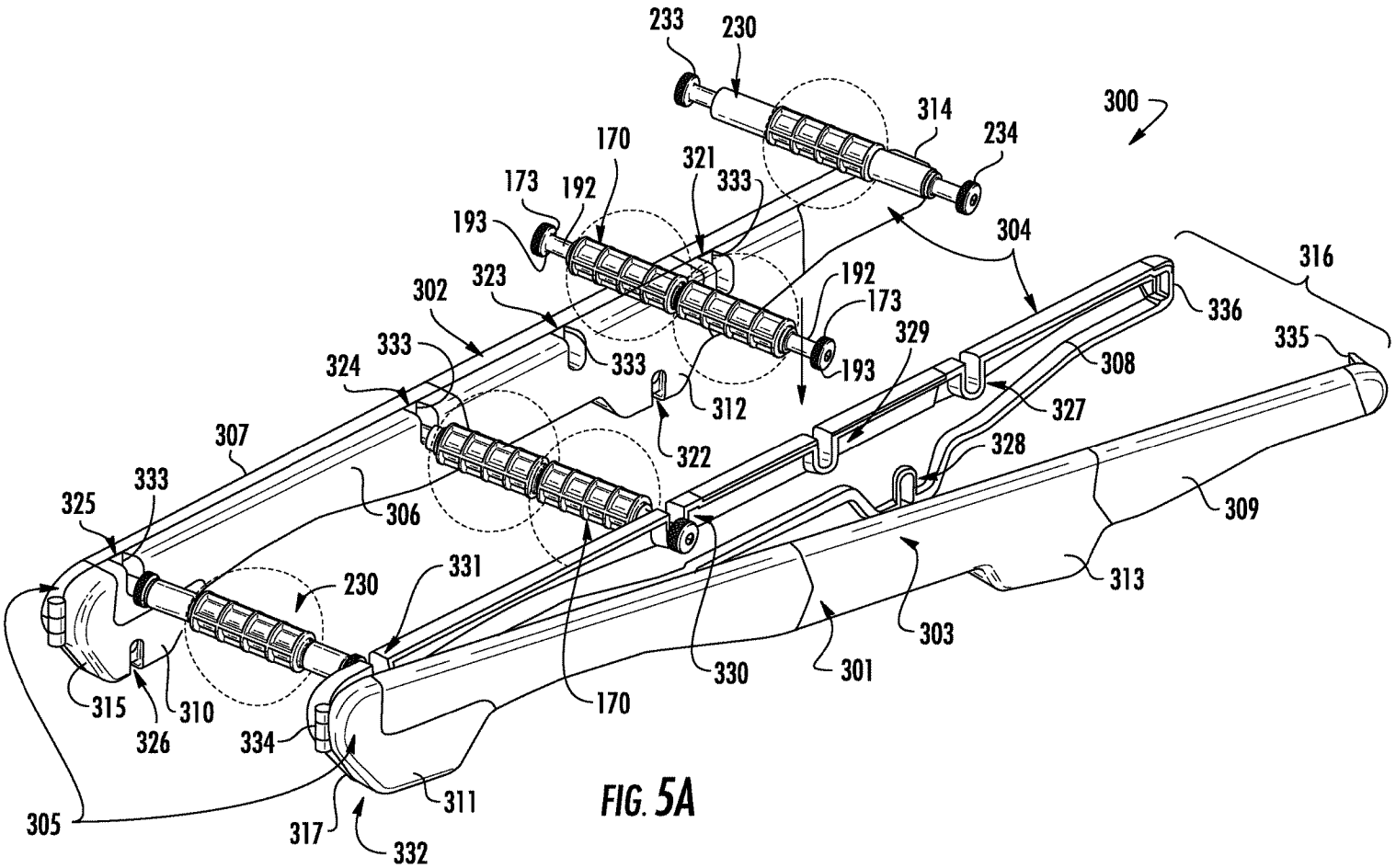
FIGS. 5A-5C are top, side, and front perspective views of another embodiment of a modular self-massaging apparatus.
Figure 5B:
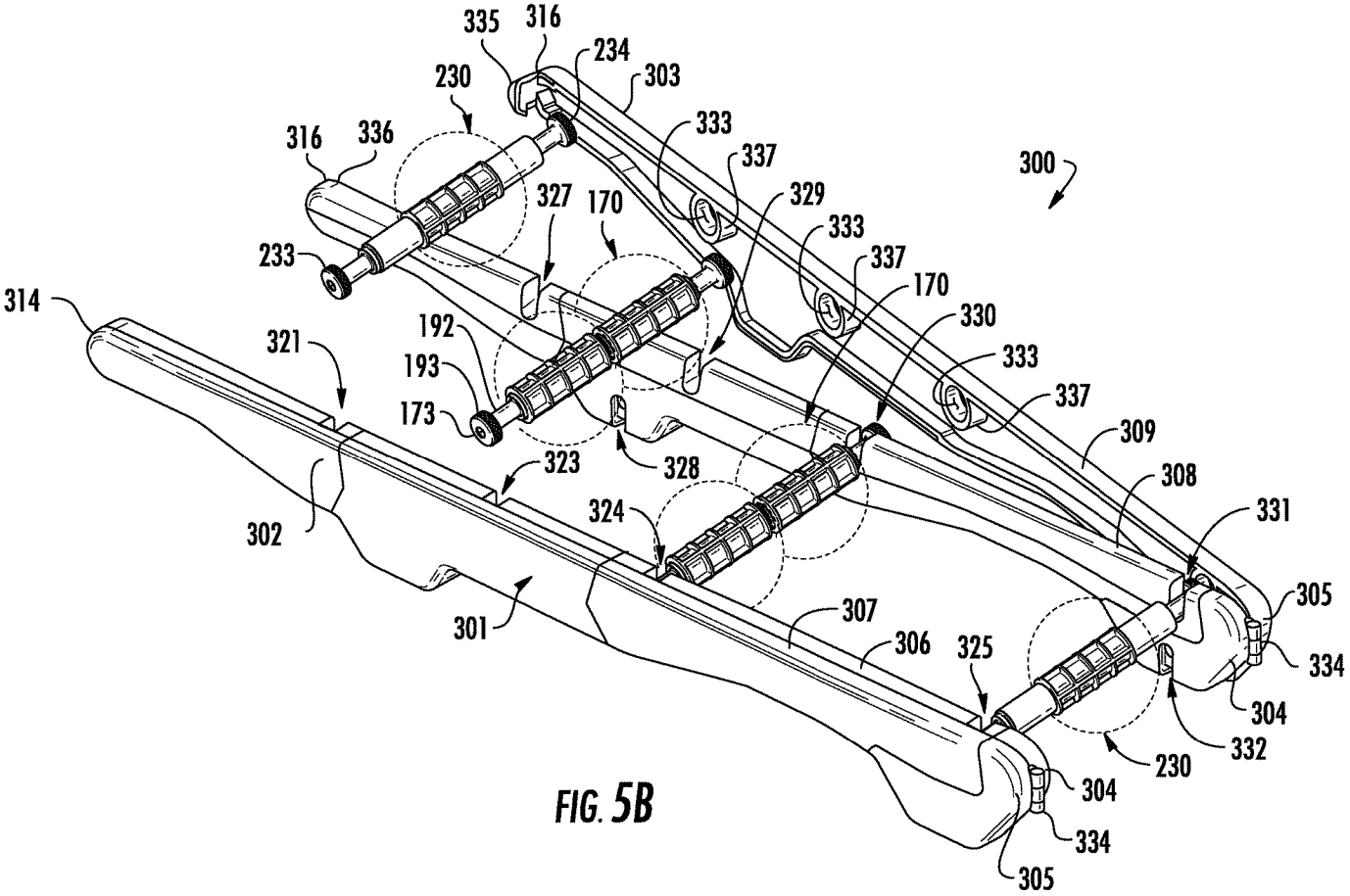
Figure 5C:
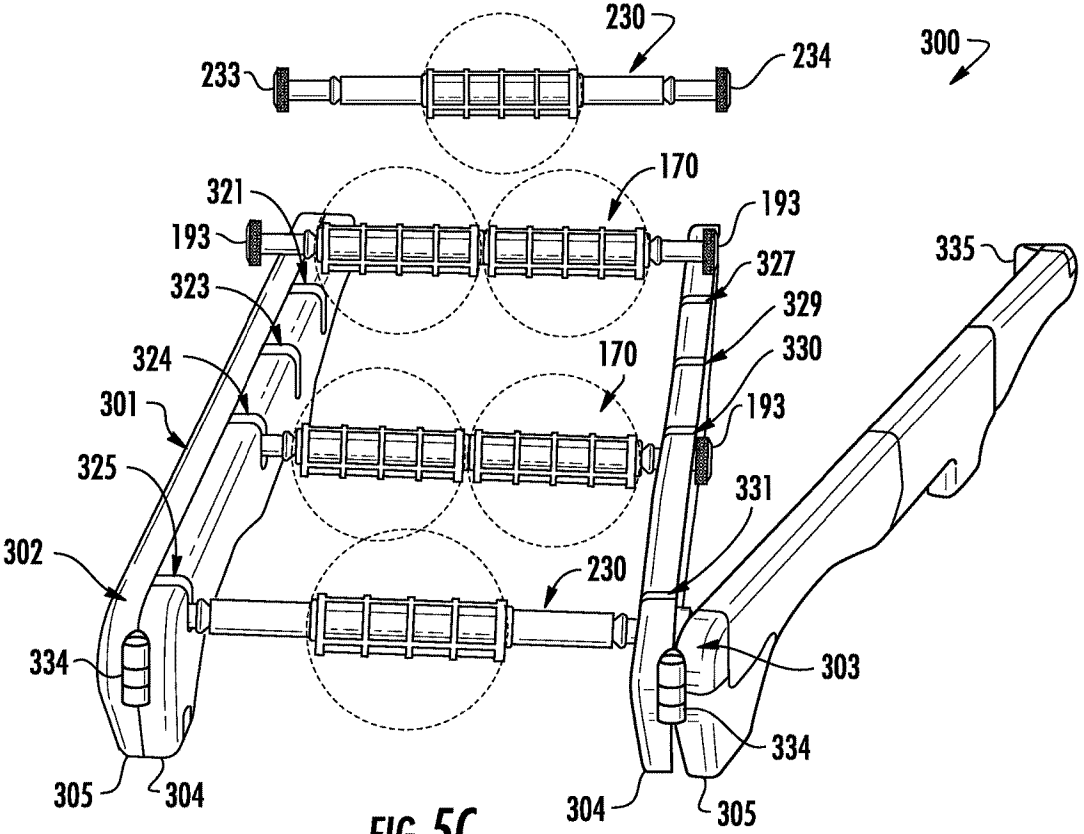

FIGS. 5A-5C illustrate an alternate embodiment of a modular self-massage apparatus 300. The apparatus 300 includes an external framework 301 including opposed left and right side members 302 and 303, cooperating to define an inner portion 304 and an outer portion 305. Both of the left and right side members 302 and 303 are bifurcated vertically: the left side member 302 is split into an inner half 306 and an opposed outer half 307, and the right side member 303 is split into an inner half 308 and an opposed outer half 309. It should be noted that although the term "half" is used to describe parts of the left and right side members 302 and 303, those parts are not true halves of a whole; they are not equal in size. The inner halves 306 and 308 define the inner portion 304 of the framework 301, and the outer halves 307 and 309 define the outer portion 305 of the framework 301. The inner and outer portions 304 and 305 are pivoted to move in a swinging fashion to move between open and closed positions. As can be seen, the left and right side members 302 and 303 are very similar to the left and right side members 14 and 15 in the apparatus 10, though not coupled to each other by braces. As such, some structural elements and features are not described in detail, as one having ordinary skill in the art will readily appreciate that the structures in the apparatus 10 and 300 are the same.

The left side member 301 is elongate and relatively thin and short. The right side member 302 is similarly elongate and relatively thin and short. Indeed, the left and right side members 301 and 302 are identical but opposite in orientation on the framework, mirrored about a centerline extending therebetween. The left and right side members 301 and 302 are spaced apart from each other, are parallel with respect to each other, and, in this parallel fashion, are disposed in the same plane such that their tops are coplanar. The left and right side members 301 and 302 are available to be gripped by hand nearly anywhere along their entire lengths, so as to provide varied and unique hand angles to exert similarly varied and unique forces.

The left and right side members 302 and 303 are spaced apart only by the ball assemblies, shown here in FIG. 5A as the first and third ball assemblies 170 and 230. The framework 301 is constructed from a material or combination of materials having the material characteristics of low density, high rigidity, high tensile strength, high compressive strength, and durability, such as plastic. When the ball assemblies are applied to the framework 301, the apparatus 300 becomes rigid.

Each of the left and right side members 302 and 303 include top surfaces, similar to the top surface 30 of the apparatus 10. The top surfaces of the left and right side members are bifurcated by the inner and outer portions 304 and 305. Additionally, each of the left and right side members 302 and 303 include bottom surfaces, which, similar to the bottom surface 40 of the apparatus 10, includes major feet 310 and 311 and minor feet 312 and 313.

The left side member 302 includes opposed first and second ends 314 and 315, and the right side member 303 includes opposed first and second ends 316 and 317. The first ends 314 and 316 are similar to the first ends 31 and 51 of the apparatus 10, respectively, and the second ends 315 and 317 are similar to the second ends 32 and 53 of the apparatus 10, respectively.

Unlike the apparatus 10, however, the apparatus 300 includes no trigger 22 and no chassis rail 12 to lock the ball assemblies in place. Instead, the inner and outer portions 304 and 305 are pivoted to each other to move between an open position, in which cradles are opened, and a closed position, in which cradles are closed.

The cradles are capture means for holding and securing the ball assemblies. The left side member 302 includes first, second, third, fourth, fifth, and sixth cradles 321, 322, 323, 324, 325, and 326, each of which is located in a location corresponding to the first, second, third, fourth, fifth, and sixth cradles 111-116 in the apparatus 10, respectively. The cradles 321-326 are formed into the inner half 306 of the left side member 302. The right side member 303 includes seventh, eighth, ninth, tenth, eleventh, and twelfth cradles 327, 328, 329, 330, 331, and 332, each of which is located in a location corresponding to the seventh, eighth, ninth, tenth, eleventh, and twelfth cradles 117-122. The cradles 327-332 are formed into the inner half 308 of the right side member 303. The cradles are all structurally identical, though there orientation in some cases is flipped.

The first cradle 321 includes a vertical notch extending downward from the top surface terminating a point just above halfway between the top and bottom surfaces. The first cradle 321 terminates in a cavity 333 bound by a socket 337 in the outer half 307. The cavity 33 is blind in the socket 337; it does not pass through the outer half 307. The first cradle 321 is a narrow slot in comparison to the larger cavity 333. The first cradle 321 is oriented vertically, such that a ball assembly is applied from the top down into the first cradle 321.

Each of the cradles depending from the top surface of the framework 300 is identical to the first cradle 321. Each of the third cradle 323, fourth cradle 324, fifth cradle 325, seventh cradle 327, ninth cradle 329, tenth cradle 330, and eleventh cradle 331 depend from the top surface 30. Each has the same cavity 333 as the first cradle 321, and as such, description of each will not be presented here. One having ordinary skill in the art will readily appreciate and understand how such structure is formed and used for the third cradle 323, fourth cradle 324, fifth cradle 325, seventh cradle 327, ninth cradle 329, tenth cradle 330, and eleventh cradle 331.

Further, the second and sixth cradles 322 and 326 have the identical structure as the first cradle 321 as well, but such structure is flipped in orientation about a horizontal. The second and sixth cradles 322 and 326 each have a cavity 333 bound by a socket 337 (shown only in FIG. 5B). Like in the first cradle 321, the slot of the second cradle 112 is formed through the inner half 306 and next to the cavity 333. However, unlike in the first cradle 321, the slot of the second cradle 322 is formed into the framework 300 from the bottom surface of the minor foot 312, and its orientation is thus reversed with respect to the first cradle 321. The sixth cradle 326 is formed and oriented similarly to the second cradle 322, though in the major foot 310 rather than the minor foot 312.

FIGS. 5A-5C illustrate the left side member 302 in a closed position and the right side member 303 in an open position. Just as with the apparatus 10, any of the first through seventh ball assemblies 170, 200, 230, 240, 260, 270, and 280, or any combination of balls from those ball assemblies, may be placed into the apparatus 300 for unique massage arrangement. To open the apparatus so as to remove or apply a ball assembly, each of the left and right side members 302 and 303 is opened. Since FIGS. 5A-5C show the right side member 303 open, the discussion will refer to that element. The inner and outer portions 302 and 303 are pivoted to each other with a vertical hinge 334 at the second end 317 of the right side member 303. The outer half 309 is swung out from the inner half 308, thereby opening the right side member 303 and opening each of the cradles formed therein. Each nut 173 held in one of the cradles in the right side member 303 can thus be removed, freeing that respective end of the ball assembly. The same action is taken with respect to the left side member 302 to entirely free the ball assembly.

To apply a ball assembly, such as the first ball assembly 170 shown in FIG. 5A, to the apparatus 300, the left and right side members 302 and 303 must first be open. The first ball assembly 170 is aligned with the third and ninth cradles 323 and 329, and the nuts 173 of the first ball assembly 170 are placed in the third and ninth cradles 323 and 329, with the shanks 192 carried in the slots of the cradles 323 and 329 formed in the inner halves 306 and 308 of the left and right side members 302 and 303, respectively. The outer halves 307 and 309 are then closed over the inner halves 306 and 308, respectively. When the outer halves 307 and 309 close, the cavities 333 in the sockets 337 of the cradles fit over and contain the heads 193 of the nuts 173 and prevent the nuts 173 from moving vertically or laterally out of the cradles 323 and 329. Further, because the slot of the cradle is smaller than the head 193, the first ball assembly 170 cannot move axially. The inner and outer halves 306 and 307 of the right side member 303 are secured with a clip 335 fit into a catch 336 on the first end 316 of the right side member 303. Similar closure structure is formed on the left side member 302.

Figure 6:
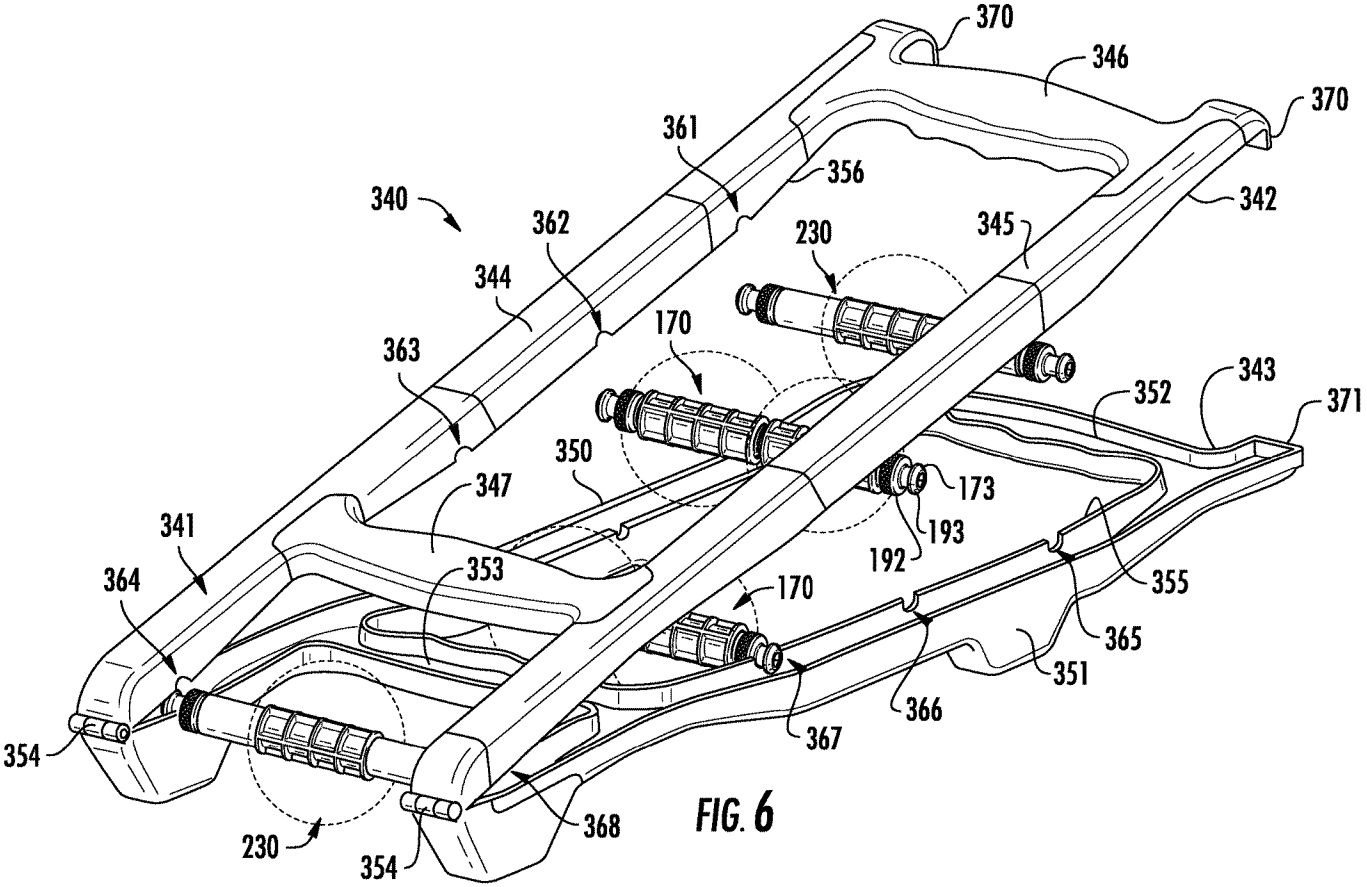
FIG. 6 is a side perspective view of yet another embodiment of a modular self-massaging apparatus.

Finally, FIG. 6 shows a third embodiment of a modular self-massage apparatus 340 with an alternate capture means. The apparatus 340 has a clam-shell design that secures any of the first, second, third, fourth, fifth, sixth, and seventh ball assemblies 170, 200, 230, 240, 260, 270, and 280. The apparatus 340 includes a framework 341 bifurcated into an upper portion 342 and a lower portion 343. The upper and lower portions 342 and 343, when closed together, are very similar to the framework 11 of the apparatus 10, with at least the exception of the trigger 22 and the various cradles of that apparatus 10.

The upper portion 342 includes two opposed, elongate left and right side members 344 and 345 and two braces 346 and 347. The braces 346 and 347 space the left and right side members 344 and 345 apart from each other and provide rigidity to the upper portion 342. The braces 346 define grips, or handles, serving not only to space the left and right side members 344 and 345 apart, but also to provide additional gripping and fulcrum locations for an individual. The upper portion 342 is constructed from a material or combination of materials having the material characteristics of low density, high rigidity, high tensile strength, high compressive strength, and durability, such as plastic. The braces 346 and 347 are formed integrally and monolithically to the left and right side members 344 and 345, though in some embodiments, for ease of manufacturing, the braces 346 and 37 are separate pieces fastened to the left and right side members 344 and 345.

The lower portion 343 includes two opposed, elongate left and right side members 344 and 345 and two braces 352 and 353. The braces 352 and 353 space the left and right side members 344 and 345 apart from each other and provide rigidity to the lower portion 343. The braces 352 define grips, or handles, serving not only to space the left and right side members 344 and 345 apart, but also to provide additional gripping and fulcrum locations for an individual. The lower portion 343 is constructed from a material or combination of materials having the material characteristics of low density, high rigidity, high tensile strength, high compressive strength, and durability, such as plastic. The braces 352 and 353 are formed integrally and monolithically to the left and right side members 344 and 345, though in some embodiments, for ease of manufacturing, the braces 352 and 37 are separate pieces fastened to the left and right side members 344 and 345.

The upper and lower portions 342 and 343 cooperate to form the capture means, namely, the several cradles for holding the ball assemblies. The upper and lower portions 342 and 343 are pivoted together at an end with two horizontal hinges 354, thereby allowing the framework 341 to open and close in a clamshell fashion. The lower portion 343 has a continuous internal edge 355 extending along the left and right side members 350 and 351 and the braces 352 and 353. Semi-circular notches are formed downward into the internal edge 355. The upper portion 342 has a similar continuous internal edge 356 extending around its left and right side members 344 and 345 and the braces 346 and 347. Semi-circular notches, corresponding to those formed in the internal edge 355 of the lower portion 343, are formed into the internal edge 356 of the upper portion 342.

These notches cooperate to form cradles. In FIG. 6, the cradles are seen in the open position, and they will be identified with reference to either their notch in the upper portion 342 or lower portion 343. First, second, third, and fourth cradles 361, 362, 363, and 364 are formed between the internal edges 355 and 356 on the left side members 344 and 350. Fifth, sixth, seventh, and eight cradles 365, 366, 367, and 368 are formed between the internal edges 355 and 356 on the right side members 345 and 351. Each of the cradles, when the apparatus 340 is closed, are circular holes defined in the framework 341, having a diameter equal to the shanks 192 of the nuts 173, and smaller than the heads 193 of the nuts 173. Thus, when the apparatus 340 is closed, the heads 193 of the nuts 173 of the ball assemblies cannot are impeded from movement out of the framework, and are thus firmly secured in place.

To apply a ball assembly, such as the first ball assembly 170 shown in FIG. 6, to the apparatus 340, the upper and lower portions 342 and 343 must first be open. The first ball assembly 170 is aligned with the second and sixth cradles 362 and 366, and the nuts 173 of the first ball assembly 170 are placed in the second and sixth cradles 362 and 366, with the shanks 192 carried in the notches of the cradles 362 and 366 formed in the internal edges 355 and 356. The upper portion 342 is then closed down on top of the lower portion 343. When the upper and lower portions 342 and 343 close, the framework 341 fit over and contain the heads 193 of the nuts 173 and prevent the nuts 173 from moving vertically or laterally out of the cradles 362 and 366. The first ball assembly 170 cannot move axially. The upper and lower portions 342 and 343 are secured with two clips 370 fit over two catches 371 on the end of the apparatus 340.

Operation of the apparatus 10 will now be discussed, with the understanding that it applies equally to the apparatus 300 and the apparatus 340. The apparatus 10 is highly modular: each of the ball assemblies can be placed in one of the several sets of cradles, and each ball assembly can be disassembled and reassembled in a different fashion; a large number of combinations of ball assemblies can be created. The disclosure herein has endeavored to describe a representative sample of those different ball assemblies, such as a single ball on an axle, two balls on an axle, a single large ball on an axle, a single ball on an axle offset from the center of the axle, two balls on a single axle with a small gap therebetween, two balls on a single axle with a large gap therebetween, etc. Other permutations are possible with the constituent elements of the balls, the axle, the nuts, and in some cases, the different spacers.

The apparatus 10 in FIG. 1 is shown with a first arrangement, namely, the third ball assembly 230 disposed at the second ends 32 and 52 of the framework 12. The third ball assembly 230 is open on one side, thereby providing an individual with nearly three-hundred and sixty degrees of access to the third ball assembly 230. In this arrangement, an individual can grasp the apparatus 10 with two hands, one on the left side member 14 and the other on the right side member 15, and roll the third ball assembly 230 against a body part. For instance, an individual may so grasp the apparatus 10 with the bottom surface 40 facing himself and with the apparatus 10 in a first end 31-up orientation, so that the third ball assembly 230 is directed downward. This orientation allows an individual to roll the apparatus 10 along the top of his leg in a soothing manner with great control and with the ability to provide a large range in force.

This first arrangement demonstrates another method of holding the apparatus 10. The individual places the brace 20 against the inside of his elbow and grips the brace 21, like a firearm braced inside the arm. The third ball assembly 230 then projects beyond the individual's hand. This allows the individual to provide a large amount of force against his own body. If the individual has selected a ball with a greater hardness, the individual can exert a lot of force and grind into his body, such along the top or sides of the leg. The brace 20 is an efficient fulcrum, disposed against the inside of the elbow, about which that force is applied.

The apparatus 10 in FIG. 1 also shows a second arrangement, namely, two first ball assemblies 170 and 170 carried in cradles proximate to each other. One of the first ball assemblies 170 is seated between the third and ninth cradles 113 and 119, and the other of the first ball assemblies 170 is seated between the fourth and tenth cradles 114 and 120. The first ball assemblies 170 are spaced apart from each other and define a small gap 380 therebetween. The gap 380 is narrow and sized to receive a hand therethrough in direct, compressive contact with each of the first ball assemblies 170. This provides an extremely soothing and therapeutic pressure on the hand as the hand is moved into and out of the gap 380 between the balls 174 of the first ball assemblies 170. If so desired, the individual can replace one of the first ball assemblies 170 with another ball assembly to form a slightly different gap and provide a slightly different massage. For instance, one of the first ball assemblies 170 could be replaced with the third ball assembly 230 having a small, single centered ball 174, or with the sixth ball assembly 270 having a large, single centered ball 274.

In a similar arrangement, the apparatus 10 is configured with a ball assemblies even more closely spaced together. The set of third and ninth cradles 113 and 119 are closer to the set of second and eighth cradles 112 and 118 than to the set of first and sixth cradles 111 and 116. Similarly, the set of first and sixth cradles 111 and 116 is closer to the set of second and eighth cradles 112 and 118 than to the third and ninth cradles 113 and 119. An individual can place, for example, a first ball assembly 170 in the third and ninth cradles 112 and 118 and another first ball assembly 170 in the second and eight cradles 112 and 118 to form a gap smaller than the 380, for even more compressive contact on a hand, or, more preferably, for a massage of just the fingers.

In yet another arrangement, the apparatus 10 is placed on the floor on the major and minor feet 34, 35, 41, and 42. The major and minor feet 34, 35, 41, and 42, with their tacky characteristics, hold the apparatus 10 steady. The individual can then set the ball assemblies in the cradles proximate the top surface 30 as desired, and roll his body against it. For instance, the individual can roll his leg along the apparatus 10. The apparatus 10, with the major and minor feet 34, 35, 41, and 42 firmly planted on the floor, resists movement, sliding, or skidding as the individual rolls his leg along the top of the apparatus 10.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. A self-massaging apparatus kit comprising:

a framework including opposed first and second ends, and first and second fulcrums located proximate to the first and second ends, respectively;

a plurality of ball assemblies;

a plurality of disparate arrangements, including:

a first arrangement, in which a first ball assembly is located at the first end of the framework; and a second arrangement, in which second and third ball assemblies are disposed proximate to each other on the framework and form a gap, and the gap is sized to receive a hand therethrough in direct, compressive contact with each of the second and third ball assemblies;

a chassis rail carried in the framework;

cradles formed by the chassis rail and the framework cooperatively, the cradles configured to receive each of the first, second, and third ball assemblies;

a trigger, moveable between an extended position and a retracted position, coupled to the chassis rail;

in the retracted position of the trigger, the chassis rail cooperates with the framework to open the cradles to allow application and removal of the plurality of ball assemblies; and in the extended position of the trigger, the chassis rail cooperates with the framework to close the cradles to prevent the application and removal of the plurality of ball assemblies.

2. The kit of claim 1, wherein the first, second, and third ball assemblies each include one of:

a single ball mounted on a hub and an axle for rotational movement of the single ball with respect to the axle; and two balls, mounted on separate hubs, and each mounted to a common axle for rotational movement of the two balls with respect to the common axle.

3. The kit of claim 2, further comprising a fourth ball assembly including a single ball offset from a central location in the fourth ball assembly.

4. The kit of claim 2, wherein the axle and the common axle are identical in structure.

5. The kit of claim 4, wherein:

the kit further includes nuts;

each of the first, second, and third ball assemblies is capped and fastened with the nuts; and the nuts engage with the framework to releasably couple the first, second, and third ball assemblies to the framework.

6. The kit of claim 2, wherein the hubs include an outer surface formed with a plurality of square depressions.

7. The kit of claim 2, wherein the hubs include an outer surface formed with a plurality of axially-spaced apart ribs and a common axial channel extends through the axially-spaced apart ribs.

8. The kit of claim 1, wherein the chassis rail is carried in the framework to reciprocate in sliding movement within the framework.

9. The kit of claim 1, wherein:

the framework has a top and a bottom; and the cradles are formed in both the top and the bottom of the framework.

10. The kit of claim 1, further comprising biasing means biasing the trigger into the extended position to close the cradles.

11. The kit of claim 1, wherein movement of the trigger between the extended and retracted positions closes and opens each of the cradles, respectively, in simultaneous fashion.

12. The kit of claim 1, wherein the trigger is carried in the first fulcrum.

13. A self-massaging apparatus comprising:

a framework, a chassis rail carried in the framework, and a cradle formed by the chassis rail and the framework cooperatively;

a ball assembly mounted to the framework at a distal location on the framework, the ball assembly including a ball mounted for rotational movement of the ball with respect to the framework;

the cradle is configured to receive the ball assembly;

a trigger, moveable between an extended position and a retracted position, coupled to the chassis rail;

in the retracted position of the trigger, the chassis rail cooperates with the framework to open the cradle to allow the application and removal of the ball assembly; and in the extended position of the trigger, the chassis rail cooperates with the framework to close the cradle to prevent application and removal of the ball assembly;

a fulcrum at a proximal location on the framework opposed from the ball assembly.

14. The apparatus of claim 13, further comprising capture means for releasably securing the ball assembly in the framework.

15. The apparatus of claim 13, further comprising:

a plurality of cradles formed in the framework;

the ball assembly is releasably mounted to the framework; and each of the plurality of cradles is configured to receive the ball assembly.

16. The apparatus of claim 13, wherein the chassis rail is carried in the framework to reciprocate in sliding movement within the framework.

17. The apparatus of claim 13, wherein the trigger is carried in the fulcrum.

* * * * *